US009472886B2

(12) United States Patent
Kang

(10) Patent No.: US 9,472,886 B2
(45) Date of Patent: Oct. 18, 2016

(54) STORAGE APPARATUS

(71) Applicants: Sony Corporation, Tokyo (JP); Sony Taiwan Limited, Taipei (TW)

(72) Inventor: Eugene Kang, New Taipei (TW)

(73) Assignees: Sony Corporation, Tokyo (JP); Sony Taiwan Limited, Taipei (TW)

( * ) Notice: Subject to any disclaimer, the term of this patent is extended or adjusted under 35 U.S.C. 154(b) by 11 days.

(21) Appl. No.: 14/551,318

(22) Filed: Nov. 24, 2014

(65) Prior Publication Data

US 2015/0162690 A1 Jun. 11, 2015

(30) Foreign Application Priority Data

Dec. 6, 2013 (JP) ..... 2013-253492

(51) Int. Cl.

| | |
|---|---|
| ***H01R 13/44*** | (2006.01) |
| ***H01R 13/447*** | (2006.01) |
| *H01R 24/62* | (2011.01) |
| *H01R 31/06* | (2006.01) |

(52) U.S. Cl.

CPC ..... *H01R 13/447* (2013.01); *H01R 24/62* (2013.01); *H01R 31/065* (2013.01)

(58) Field of Classification Search

CPC H01R 13/60; H01R 13/447; H01R 13/5213; H01R 13/506

USPC ..... 439/131, 135, 136

See application file for complete search history.

(56) References Cited

U.S. PATENT DOCUMENTS

| | | | | |
|---|---|---|---|---|
| 6,456,500 | B1 * | 9/2002 | Chen | 361/752 |
| 7,416,424 | B1 * | 8/2008 | Deckman | 439/135 |
| 7,547,218 | B2 * | 6/2009 | Hiew et al. | 439/135 |
| 8,125,774 | B2 * | 2/2012 | Kelley et al. | 361/679.31 |
| 8,625,270 | B2 * | 1/2014 | Ni et al. | 361/679.31 |
| 9,206,951 | B2 * | 12/2015 | McLennan et al. | |
| 9,215,820 | B2 * | 12/2015 | Villa-Real | |
| 2006/0026348 | A1 | 2/2006 | Wallace et al. | |
| 2011/0072700 | A1 * | 3/2011 | Theresa et al. | 40/638 |
| 2013/0050910 | A1 | 2/2013 | Pang | |

FOREIGN PATENT DOCUMENTS

| | | |
|---|---|---|
| JP | 2005-158712 | 6/2005 |
| JP | 2006-301789 | 11/2006 |
| JP | 2008-506192 | 2/2008 |
| JP | 2013-054723 | 3/2013 |

* cited by examiner

*Primary Examiner* — Hien Vu
(74) *Attorney, Agent, or Firm* — K&L Gates LLP

(57) ABSTRACT

There is provided a storage apparatus including an apparatus body including at least one connector connected by being inserted into a connection terminal provided in an electronic device and disconnected by being pulled out from the connection terminal and a connector holding portion holding the connector, and a cap attached/detached to/from the connector holding portion. A direction in which the connector is inserted into the connection terminal is set as an insertion direction, a direction in which the connector is pulled out from the connection terminal is set as a pulling direction, the cap is provided with a locked portion locked with respect to the connector holding portion, and the connector holding portion is provided with a locking portion engaged with the locked portion to regulate detachment of the cap from the connector holding portion in the pulling direction.

10 Claims, 21 Drawing Sheets

STORAGE APPARATUS

CROSS REFERENCES TO RELATED APPLICATIONS

The present application claims priority to Japanese Priority Patent Application JP 2013-253492 filed in the Japan Patent Office on Dec. 6, 2013, the entire content of which is hereby incorporated by reference.

BACKGROUND

The present application relates to a technical field of a storage apparatus including an apparatus body having a connector inserted into a connection terminal provided in an electronic device and a cap attached/detached to/from the apparatus body.

A storage apparatus including an apparatus body having a connector inserted into a connection terminal provided in an electronic device and a cap attached/detached to/from the apparatus body is available and in such a storage apparatus, the connection of the connector to the connection terminal is cut off by the connector being pulled out in a direction opposite to the direction in which the connector is inserted into the connection terminal (see, for example, JP 2013-54723A, JP 2006-301789A, and JP 2005-158712A).

Storage apparatuses described in JP 2013-54723A, JP 2006-301789A, and JP 2005-158712A are structured such that the loss of the cap protecting the connector is prevented.

In a storage apparatus described in JP 2013-54723A, a cap is made slidable with respect to an apparatus body, the apparatus body is provided with an insertion pin capable of moving in a direction perpendicular to a sliding direction of the cap with respect to the apparatus body, and the cap has two fixed holes into which the insertion pin is inserted formed by being separated in the sliding direction. A connector is protected by being covered with the cap while the insertion pin is inserted into one fixed hole and the connector is projected from the cap to be able to connect to the connection terminal of an electronic device while the insertion pin is inserted into the other fixed hole after the cap being slid. Because the cap is supported on the apparatus body both when the connector is used and not used, the loss of the cap be prevented.

In a storage apparatus described in JP 2006-301789A, a guide groove is formed on each of surface portions on both sides of an apparatus body, a pair of arm portions projecting toward the apparatus body is provided on each of surface portions on both sides of a cap, and also a slider is provided at the tip of each arm portion. The slider is freely slidingly supported by the guide groove and the cap is made rotationally movable with respect to the apparatus body using the slider as a supporting point. A connector is protected by being covered with the cap while the slider is supported by one end of the guide groove and the connector is made connectable to the connection terminal of an electronic device while the cap is rotationally moved with respect to the apparatus body after the slider is slid into the guide groove by the cap being moved with respect to the apparatus body. Because the cap is supported on the apparatus body both when the connector is used and not used, the loss of the cap be prevented.

A storage apparatus described in JP 2005-158712A has a pair of guide grooves including a circular groove and a lead-in groove formed in an apparatus body and a cap is provided with a pair of projections freely slidingly supported by the respective guide grooves. The cap is rotationally moved with respect to the apparatus body by the projection being slid by the circular groove and the cap is slid with respect to the apparatus body by the projection being slid by the lead-in groove. A connector is protected by being covered with the cap while the projection is supported by one end of the lead-in groove and the connector is made connectable to the connection terminal of an electronic device while the cap is rotationally moved after being slid with respect to the apparatus body. Because the cap is supported on the apparatus body both when the connector is used and not used, the loss of the cap be prevented.

On the other hand, in addition to the above type of storage apparatus in which the cap is made slidable or rotationally movable, a type in which the cap is made attachable/detachable to/from the apparatus body is known (see, for example, JP 2008-506192T).

In such a type in which the cap is attachable/detachable, while a connector is connected to the connection terminal, the cap may be engaged and attached to an end on the opposite side of the side on which the connection terminal of the apparatus body is provided. The loss of the cap can be prevented by attaching the cap to an end of the apparatus body while the connector is connected to the connection terminal.

As described above, the loss of the cap can be prevented by configuring the cap to be slidable or rotationally movable with respect to the apparatus body or by configuring the cap to be attachable/detachable to/from an end of the apparatus body.

SUMMARY

Incidentally, in the type in which the cap is configured to be attachable/detachable to/from an end of the apparatus body as described in JP 2008-506192T, the cap is attached to the end of the apparatus body while the connector is connected to the connection terminal and thus, when the storage apparatus is detached from an electronic device, a pulling operation from the connection terminal of the connector may be performed while the cap is gripped by the user.

However, if an attempt is made to pull out the connector while the cap being gripped, the cap may be detached from the apparatus body and in such a case, it is difficult to detach the storage apparatus from the electronic device.

Thus, it is desired for a storage apparatus according to the present application to overcome the above problem to prevent the loss of the cap and also to prevent the cap from being detached from the apparatus body when a pulling operation of the connector from the connection terminal is performed.

According to the first aspect of the present disclosure, there is provided a storage apparatus including an apparatus body including at least one connector connected by being inserted into a connection terminal provided in an electronic device and disconnected by being pulled out from the connection terminal and a connector holding portion holding the connector, and a cap attached/detached to/from the connector holding portion. A direction in which the connector is inserted into the connection terminal is set as an insertion direction, a direction in which the connector is pulled out from the connection terminal is set as a pulling direction, the cap is provided with a locked portion locked with respect to the connector holding portion, and the connector holding portion is provided with a locking portion engaged with the locked portion to regulate detachment of the cap from the connector holding portion in the pulling direction.

Accordingly, when the cap is made connectable to the connector holding portion while the connector is connected to the connection terminal and also a pulling operation of the connector from the connection terminal is performed while the cap is gripped, detachment of the cap from the connector holding portion in the pulling direction is regulated by the locking portion.

According to the second aspect of the present disclosure, in the storage apparatus, it is desired that the cap be locked with respect to the connector holding portion and unlocked with respect to the connector holding portion by the cap being rotated in an axis rotating direction of an axis parallel to the insertion direction with respect to the connector holding portion.

Accordingly, the locking portion and the locked portion are engaged and disengaged by rotation of the cap with respect to the connector holding portion.

According to the third aspect of the present disclosure, in the storage apparatus, it is desired that a plane portion be formed on an outside surface of the cap.

Accordingly, when the cap rotates with respect to the apparatus body, the user can put his (her) fingers on the plane portion to rotate the cap.

According to the fourth aspect of the present disclosure, in the storage apparatus, it is desired that the cap be locked with respect to the connector holding portion and unlocked with respect to the connector holding portion by the cap being moved in the insertion direction or the pulling direction with respect to the connector holding portion.

Accordingly, the locking portion and the locked portion are engaged and disengaged by movement of the cap with respect to the connector holding portion.

According to the fifth aspect of the present disclosure, in the storage apparatus, it is desired that the connector be projected in one direction from the connector holding portion, and that the locking portion be provided in a portion on an opposite side of a side on which the connector is projected.

Accordingly, the cap can be attached to the connector holding portion while the connector is connected to the connection terminal.

According to the sixth aspect of the present disclosure, in the storage apparatus, it is desired that different types of a first connector and a second connector be provided as the connector.

Accordingly, the first connector and the second connector can be connected to connection terminals of mutually different types of electronic devices.

According to the seventh aspect of the present disclosure, in the storage apparatus, it is desired that the first connector and the second connector be positioned in a state projected in opposite directions from the connector holding portion.

Accordingly, the first connector and the second connector can be connected to connection terminals of mutually different types of electronic devices by reversing the direction of the storage apparatus.

According to the eighth aspect of the present disclosure, in the storage apparatus, it is desired that the cap be attached to the connector holding portion and locked in the state covering the second connector.

Accordingly, the second connector is covered with the cap while the first connector is connected to the connection terminal.

According to the ninth aspect of the present disclosure, in the storage apparatus, it is desired that a connecting band connecting the cap and the connector holding portion be provided.

Accordingly, even while the cap is detached from the connector holding portion, the cap is connected to the connector holding portion via the connecting band.

According to the tenth aspect of the present disclosure, in the storage apparatus, it is desired that the connecting band be made elastically deformable.

Accordingly, even while the cap is detached from the connector holding portion, the connecting band is bendable.

According to the eleventh aspect of the present disclosure, in the storage apparatus, it is desired that the cap be made slidable with respect to the connecting band.

Accordingly, the cap and the connector holding portion can be separated or contacted by sliding the cap with respect to the connecting band while the cap and the connector holding portion are coupled to the connecting band.

According to the twelfth aspect of the present disclosure, in the storage apparatus, it is desired that the connecting band be positioned inside the cap while the cap is attached to the connector holding portion.

Accordingly, the connecting band is not projected to the outer side from the cap and the connector holding portion while the cap is attached to the connector holding portion.

According to the thirteenth aspect of the present disclosure, in the storage apparatus, it is desired that the locked portion be provided on an inner surface side of the cap, and that the locking portion be positioned inside the cap while the cap is attached to the connector holding portion.

Accordingly, the locking portion and the locked portion are not projected to the outer side from the connector holding portion while the cap is attached to the connector holding portion.

According to the present application, when the cap is made connectable to the connector holding portion while the connector is connected to the connection terminal and also a pulling operation of the connector from the connection terminal is performed while the cap is gripped, detachment of the cap from the connector holding portion in the pulling direction is regulated by the locking portion. Therefore, the loss of the cap can be prevented and also the cap can be prevented from falling off the apparatus body when a pulling operation of the connector from the connection terminal is performed.

Additional features and advantages are described herein, and will be apparent from the following Detailed Description and the figures.

DETAILED DESCRIPTION

Figure 1:
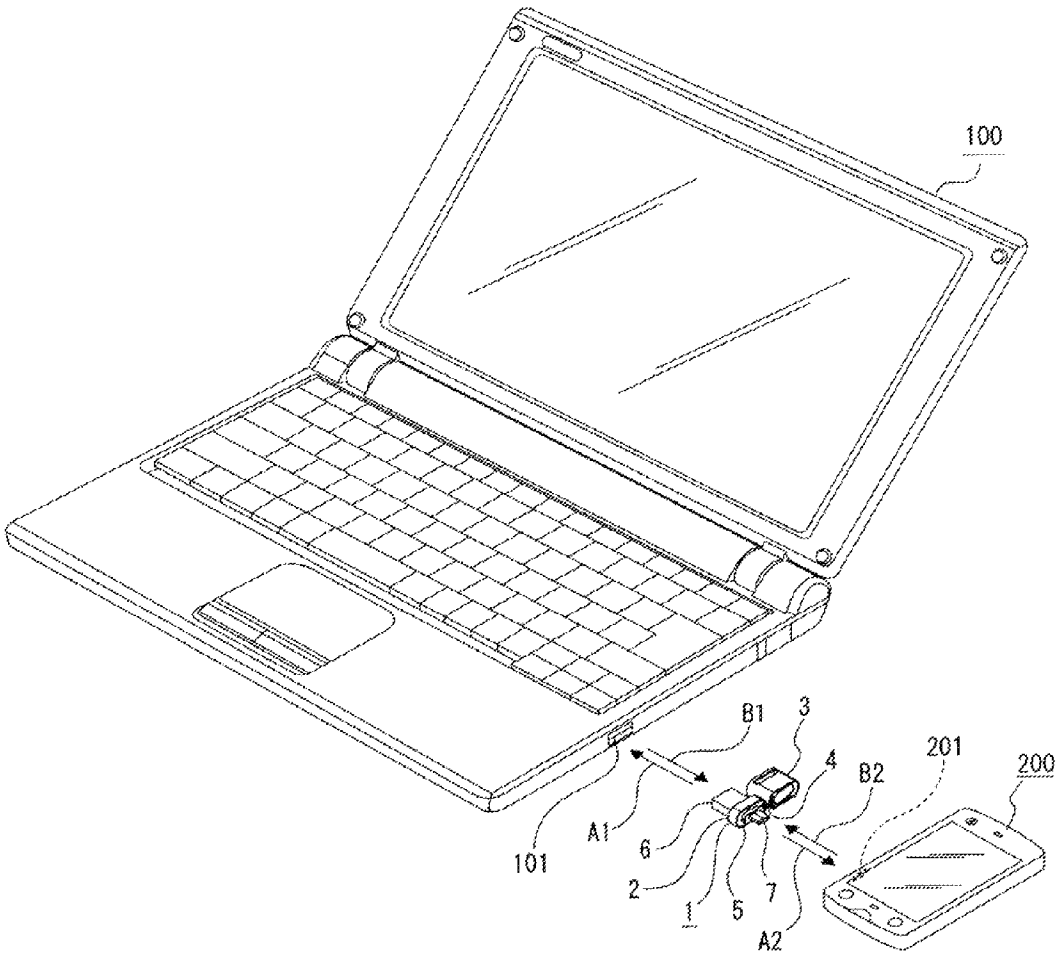
FIG. 1 shows a storage apparatus according to the present application together with FIGS. 2 to 23 and is a perspective view of the storage apparatus and an electronic device.

An embodiment to carry out a storage apparatus according to the present application will be described below in accordance with the attached drawings.

A storage apparatus has a connector holding portion and two connectors projecting in the opposite direction from the connector holding portion and the two connectors are formed in a flat shape. In the description that follows, the direction in which connectors are arranged is assumed to be an up and down direction, the direction of width of the connector is assumed to be a left and right and the direction of thickness of the connector is assumed to be a forward and backward direction.

The directions of up and down, forward and backward, and left and right shown below are set for convenience sake and when carrying out the present application, the direction is not limited to the above directions.

[Configuration of the Storage Apparatus]

A storage apparatus 1 includes an apparatus body 2, a cap 3, and a connecting band 4 (see FIGS. 1 to 5). The storage apparatus 1 has a function to exchange data with various electronic devices 100, 200, . . . (see FIG. 1). The electronic device 100 is, for example, a personal computer and the electronic device 100 is provided with a connection terminal 101. The electronic device 200 is, for example, a mobile terminal such as a mobile phone and the electronic device 200 is provided with a connection terminal 201. The connection terminals 101, 201 of the electronic devices 100, 200 are, for example, USB (Universal SerialBus) terminals and the connection terminal 201 is a so-called micro USB terminal smaller than the connection terminal 101.

Figure 2:
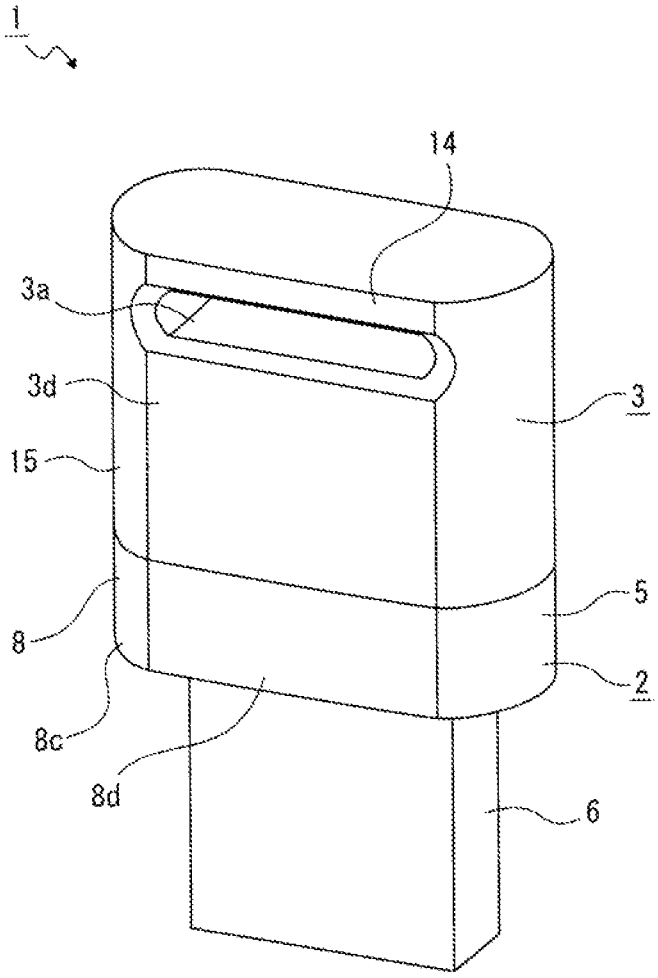
FIG. 2 is an enlarged perspective view of the storage apparatus shown in a state in which a cap is attached to a connector holding portion.
Figure 3:
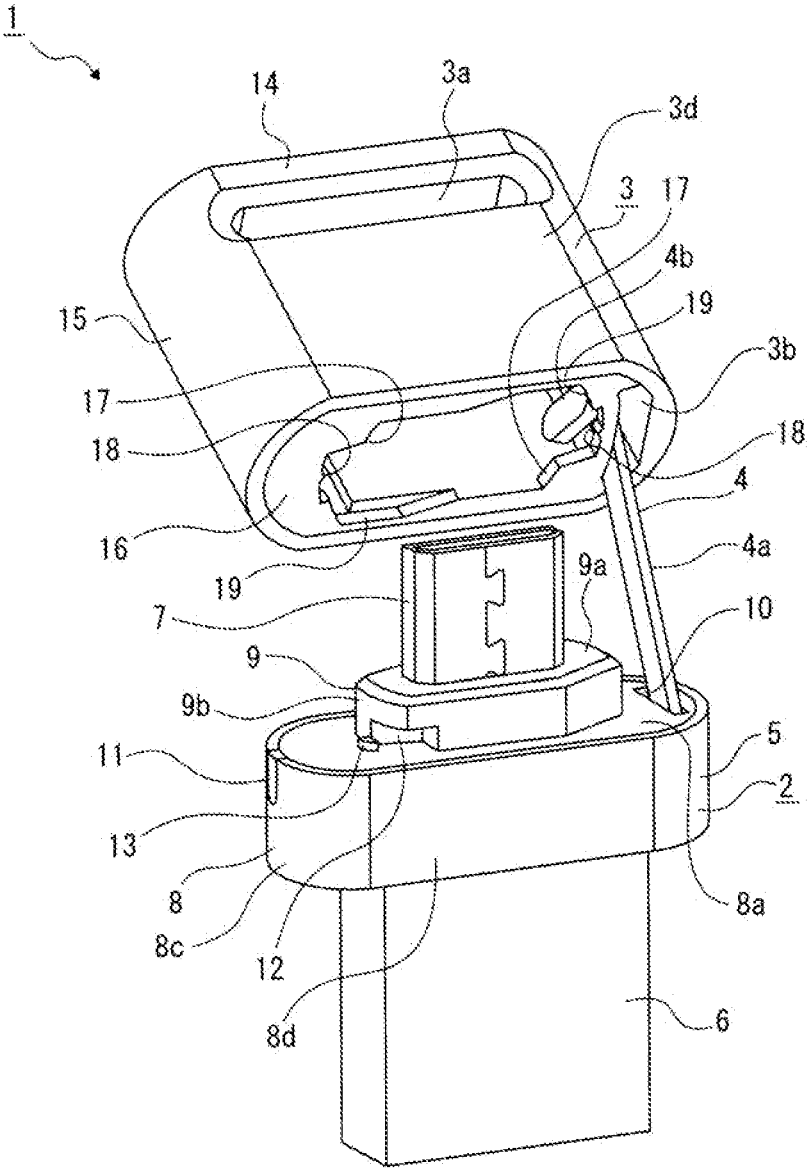
FIG. 3 is an enlarged perspective view of the storage apparatus shown in a state in which the cap is detached from the connector holding portion.
Figure 4:
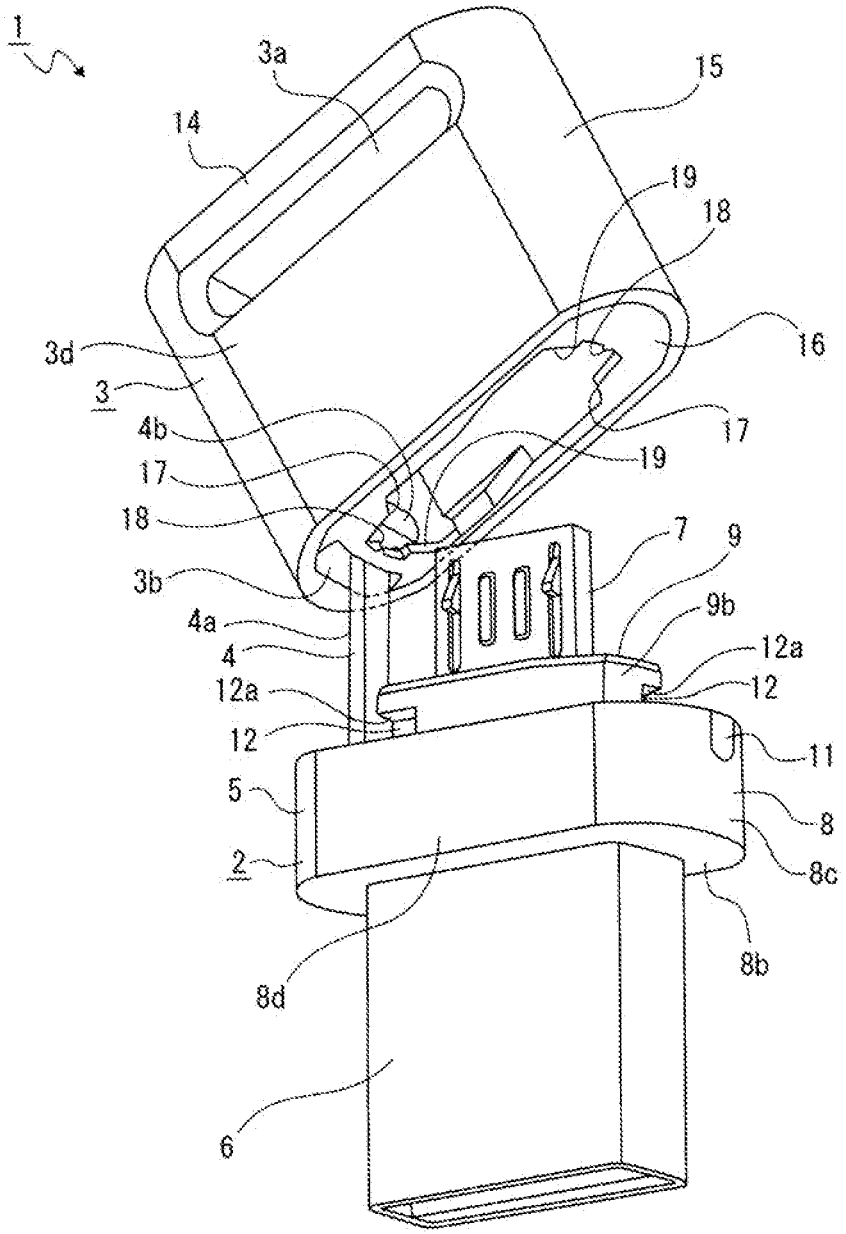
FIG. 4 is an enlarged perspective view of the storage apparatus showing the state in which the cap is detached from the connector holding portion when viewed from a direction different from that in FIG. 3.

The apparatus body 2 includes a connector holding portion 5 formed from a resin material and a first connector 6 and a second connector 7, each held by the connector holding portion 5 (see FIGS. 2 to 4).

The first connector 6 is connected to the connection terminal 101 of the electronic device 100 and the second connector 7 is connected to the connection terminal 201 of the electronic device 200 (see FIG. 1). The first connector 6 and the second connector 7 are connected by being inserted into the connection terminals 101, 201 in the projection directions from the apparatus body 2 respectively and the connections of the first connector 6 and the second connector 7 to the connection terminals 101, 201 are cut by the storage apparatus 1 being pulled out in the opposite direction.

The directions in which the first connector 6 and the second connector 7 are inserted into the connection terminals 101, 201 are set as insertion directions A1, A2 respectively and the directions in which the first connector 6 and the second connector 7 are pulled out from the connection terminals 101, 201 are set as pulling directions B1, B2 respectively.

The connector holding portion 5 of the apparatus body 2 is formed by a substrate portion 8 and a coupling portion 9 being integrally formed (see FIGS. 2 to 4).

The substrate portion 8 is formed in an oblong shape extending to the left and right and the outside surface thereof is formed of a top face 8*a*, an underside 8*b*, and an outer circumferential surface 8*c*. Portions of the outer circumferential surface 8*c* of the substrate portion 8 are formed as plane portions 8*d*, 8*d* oriented in mutually opposite directions in the horizontal direction.

A memory (not shown) is arranged inside the substrate portion 8 various kinds of data are stored in the memory. An insertion hole 10 opened upward is formed on one end in the longitudinal direction of the substrate portion 8.

A cover 11 is attached to the other end in the longitudinal direction of the substrate portion 8. A light source such as a light emitting diode (not shown) is arranged inside the substrate portion 8 and, for example, while the first connector 6 is connected to the connection terminal 101 or the second connector 7 is connected to the connection terminal 201, light emitted from the light source when data is exchanged between the electronic devices 100, 200 and the storage apparatus 1 is irradiated outside via the cover 11. The user can make sure that data is exchanged between the electronic devices 100, 200 and the storage apparatus 1 through outside irradiation of light via the cover 11.

The coupling portion 9 is projected upward from the top face 8*a* of the substrate portion 8 and formed in an oblong shape. The outside surface of the coupling portion 9 is formed of a top surface 9*a* and a circumferential surface 9*b*.

The coupling portion 9 has locking portions 12, 12 formed in positions 180° opposite to each other on the circumferential surface portion. The locking portion 12 is formed in a groove shape opened to the outer side and an upper wall surface forming the locking portion 12 is formed as a regulating surface 12*a*. Engagement projections 13, 13 projected to the outer side are provided at one open edge in a circumferential direction of the locking portions 12, 12 on the circumferential surface 9*b* of the coupling portion 9 respectively.

The first connector 6 is projected downward from the underside 8*b* of the substrate portion 8 and formed in a flat shape whose forward and backward portions are thin.

The second connector 7 is projected upward from the top surface 9*a* of the coupling portion 9 and formed in a flat shape whose forward and backward portions are thin. The second connector 7 is made smaller than the first connector 6.

The cap 3 includes a base portion 14 positioned on the upper side, a circumferential surface portion 15 projected downward from an outer circumferential portion of the base portion 14, and an overhanging surface portion 16 overhung to the inner side from the lower end of the circumferential surface portion 15 (see FIG. 3 to FIG. 6). The cap 3 has a strap insertion hole 3*a* passed through in the forward and backward direction formed in a top end portion thereof.

A slide hole 3*b* extending in an up and down direction is formed on the inner surface side of one end in the left and right direction of the cap 3 and is opened downward in the overhanging surface portion 16. A connecting hole 3*c* communicatively connected to the slide hole 3*b* and extending in an up and down direction is formed inside the cap 3.

Portions of the outer circumferential surface of the cap 3 are formed as plane portions 3*d*, 3*d* oriented in mutually opposite directions in the horizontal direction.

Locked portions 17, 17 projected more to the inner side than other portions are provided in an inner circumferential portion of the overhanging surface portion 16 by being spaced in the circumferential direction. Stopping projections 18, 18 projected to the inner side in the circumferential direction near the locked portions 17, 17 are provided in the inner circumferential portion of the overhanging surface portion 16 respectively. Clearance recesses 19, 19 notched to the outer side are formed in the inner circumferential portion of the overhanging surface portion 16 by being spaced in the circumferential direction. The locked portions 17, 17 and the clearance recesses 19, 19 are positioned alternately in the circumferential direction.

Figure 7:
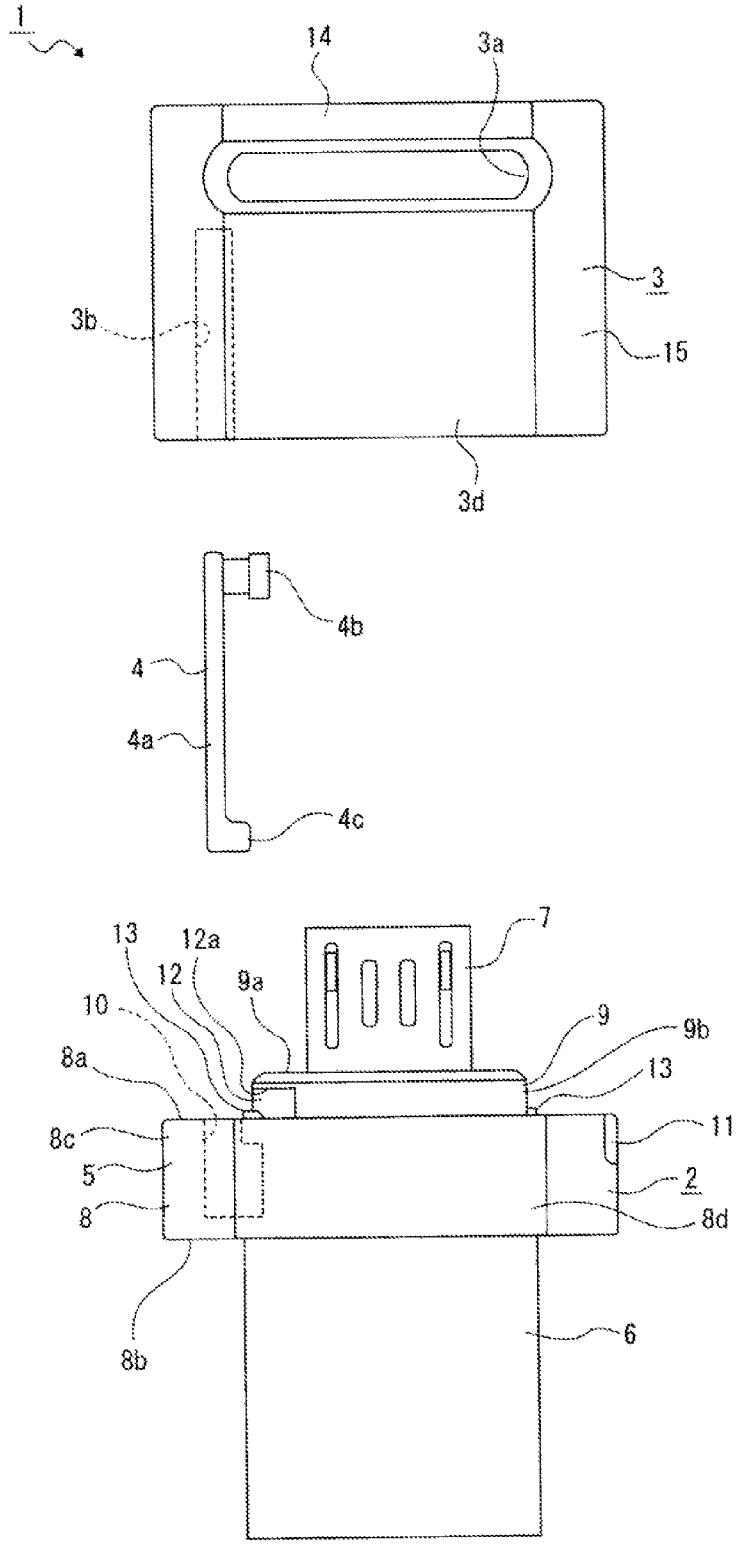
FIG. 7 is an enlarged front view of the storage apparatus shown in a state in which the cap, the apparatus body, and the connecting band are separated.

The connecting band 4 is formed from an elastically deformable material such as rubber and is formed by, as shown in FIG. 7, a connecting portion 4*a* extending linearly while not being elastically deformed and a first projecting portion 4*b* and a second projecting portion 4*c* projected in a direction perpendicular to the direction in which the connecting portion 4*a* extends from both ends of the connecting portion 4*a* being integrally formed.

Figure 8:
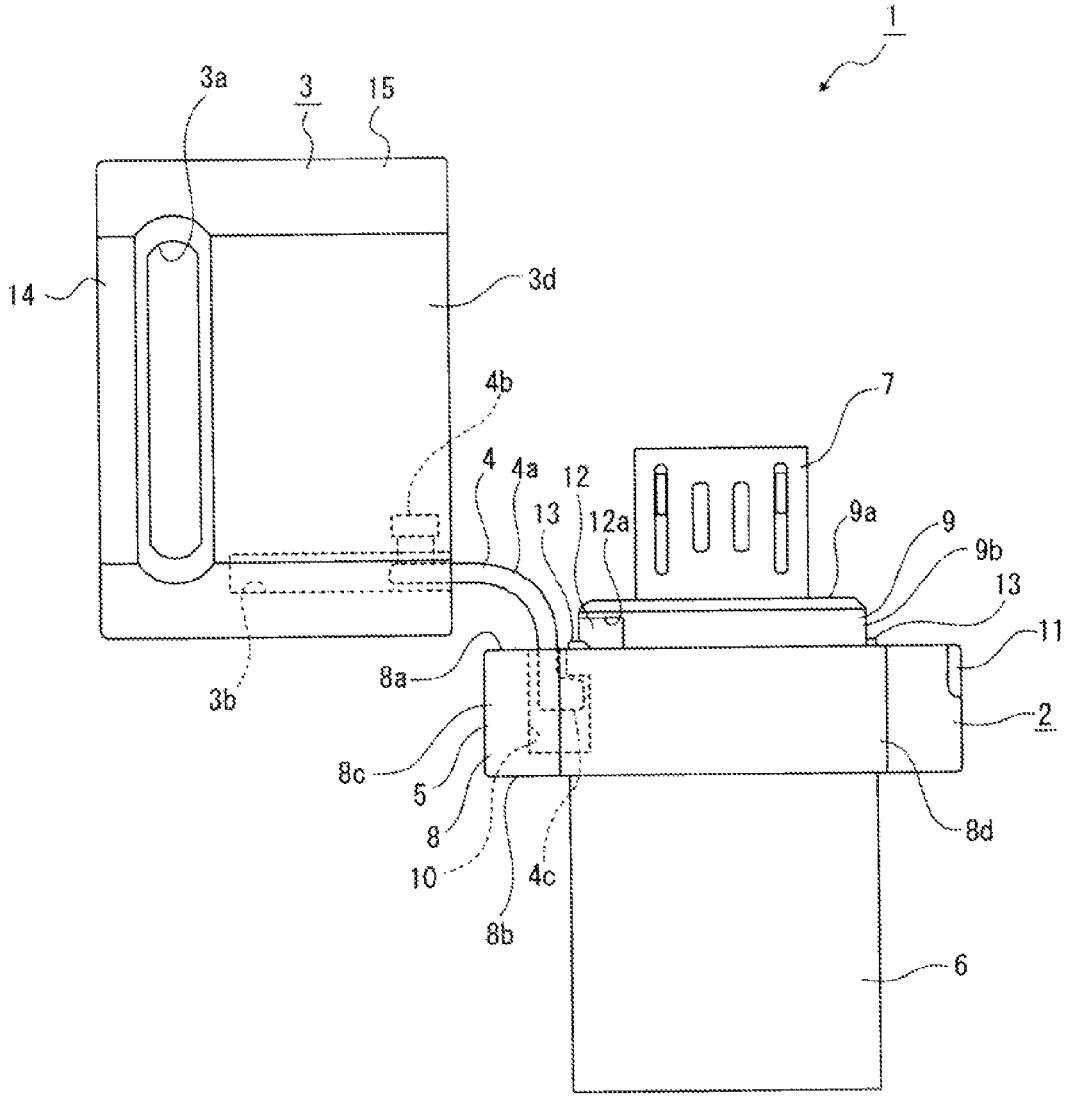
FIG. 8 is an enlarged front view showing a state in which the cap is detached from the connector holding portion and the connecting band is bent.

The connecting band 4 is connected to the cap 3 by the first projecting portion 4*b* and a portion of the connecting portion 4*a* on the side of the first projecting portion 4*b* being inserted into the slide hole 3*b* of the cap 3 and the tip portion of the first projecting portion 4*b* being projected from the connecting hole 3*c* (see FIGS. 3 and 8). Also, the connecting band 4 is connected to the connector holding portion 5 by the second projecting portion 4*c* and a portion of the connecting portion 4*a* on the side of the second projecting portion 4*c* being inserted into the insertion hole 10 formed in the substrate portion 8 of the connector holding portion 5 and the second projecting portion 4*c* being enabled to engage with a portion of the substrate portion 8.

Figure 5:
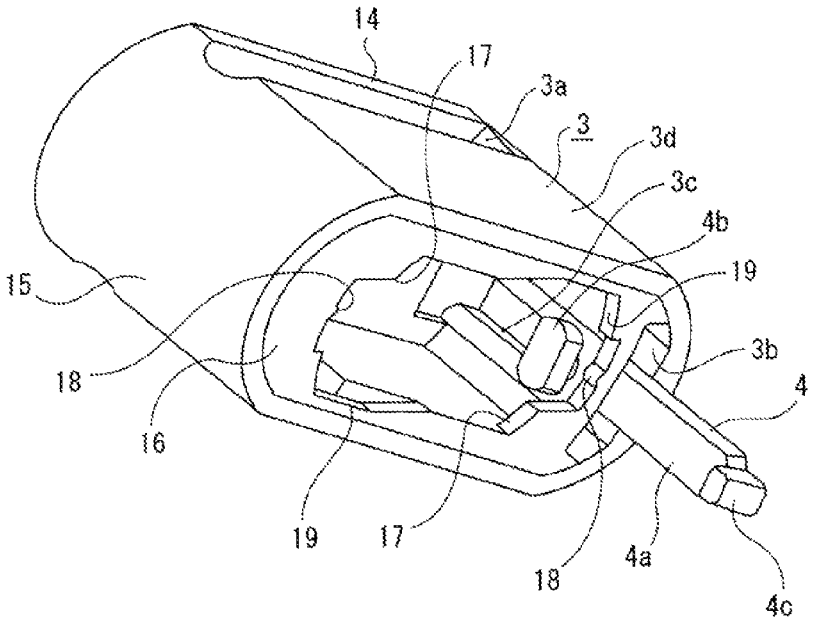
FIG. 5 shows a configuration in which the cap is slid with respect to a connecting band together with FIG. 6 and is an enlarged perspective view showing a state in which the cap is positioned on one movement end with respect to the connecting band.
Figure 6:
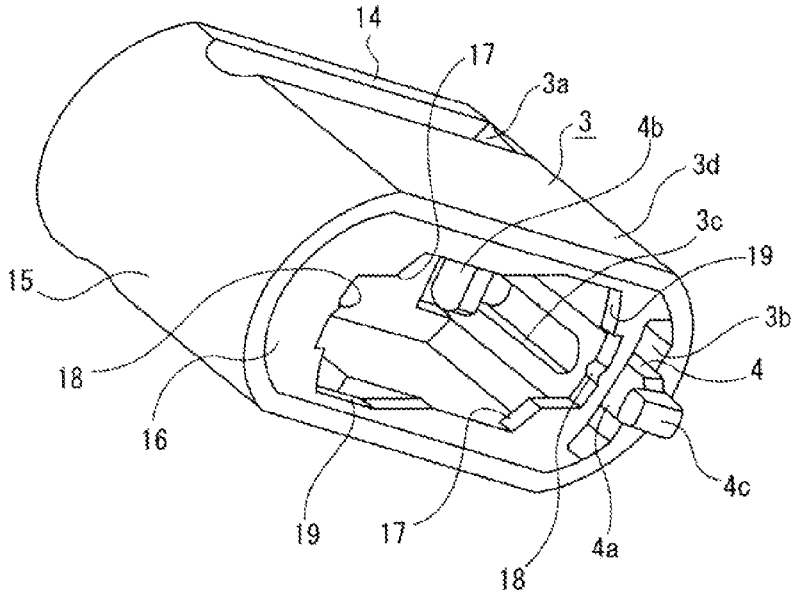
FIG. 6 is an enlarged perspective view showing a state in which the cap is positioned on one movement end with respect to the connecting band.

The cap 3 is made slidable with respect to the connecting band 4 in a direction in which the connecting portion 4*a* extends (see FIGS. 5 and 6). In addition, the apparatus body 2 is made displaceable in a direction in which the connecting portion 4*a* extends with respect to the connecting band 4 within a range in which the second projecting portion 4*c* can be displaced in the insertion hole 10.

The connecting band 4 is formed from, as described above, an elastically deformable material such as rubber and so is made bendable while the cap 3 is detached from the apparatus body 2 (see FIG. 8). Therefore, while detached from the apparatus body 2, the cap 3 is held in a position separated from the connector holding portion 5 in a state connected to the connector holding portion 5 via the connecting band 4.

In the storage apparatus 1, as described above, the connecting band 4 connecting the cap 3 and the connector holding portion 5 is provided.

Therefore, even while the cap 3 is detached from the connector holding portion 5, the cap 3 is connected to the connector holding portion 5 via the connecting band 4 and therefore, the loss of the cap 3 can be prevented.

[Attaching/Detaching Operation to/from the Cap]

The attaching/detaching operation of the cap 3 to/from the apparatus body 2 will be described below (see FIGS. 9 to 15).

Figure 9:
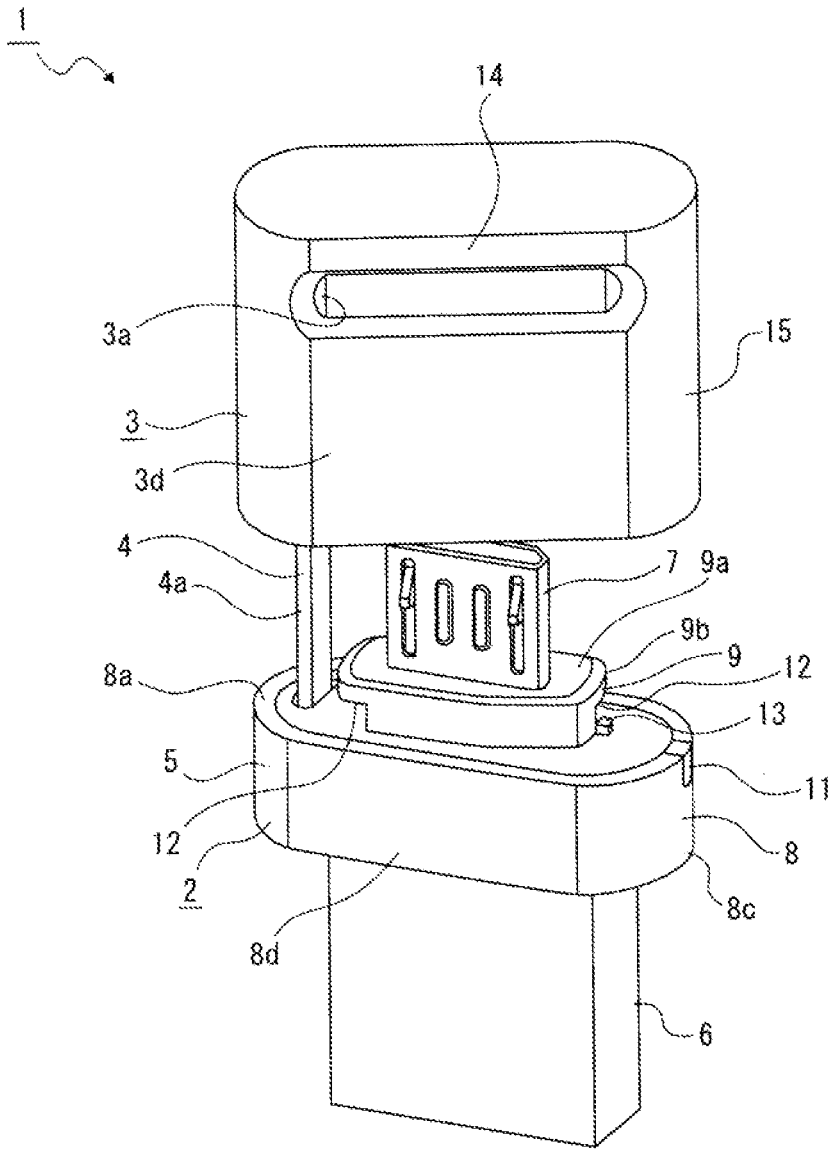
FIG. 9 shows an attaching/detaching operation of the cap to/from the connector holding portion together with FIGS. 10 to 15 and is an enlarged perspective view showing the state in which the cap is detached from the connector holding portion.

First, a state in which the cap 3 is detached from the apparatus body 2 will be described (see FIG. 9). While the cap 3 is detached from the apparatus body 2, the cap is held in a position separated from the connector holding portion 5 in a state connected to the connector holding portion 5 of the apparatus body 2 via the connecting band 4. In this case, for example, the cap 3 is held in a position most separated from the connector holding portion 5 after being slid with respect to the connecting band 4.

Figure 10:
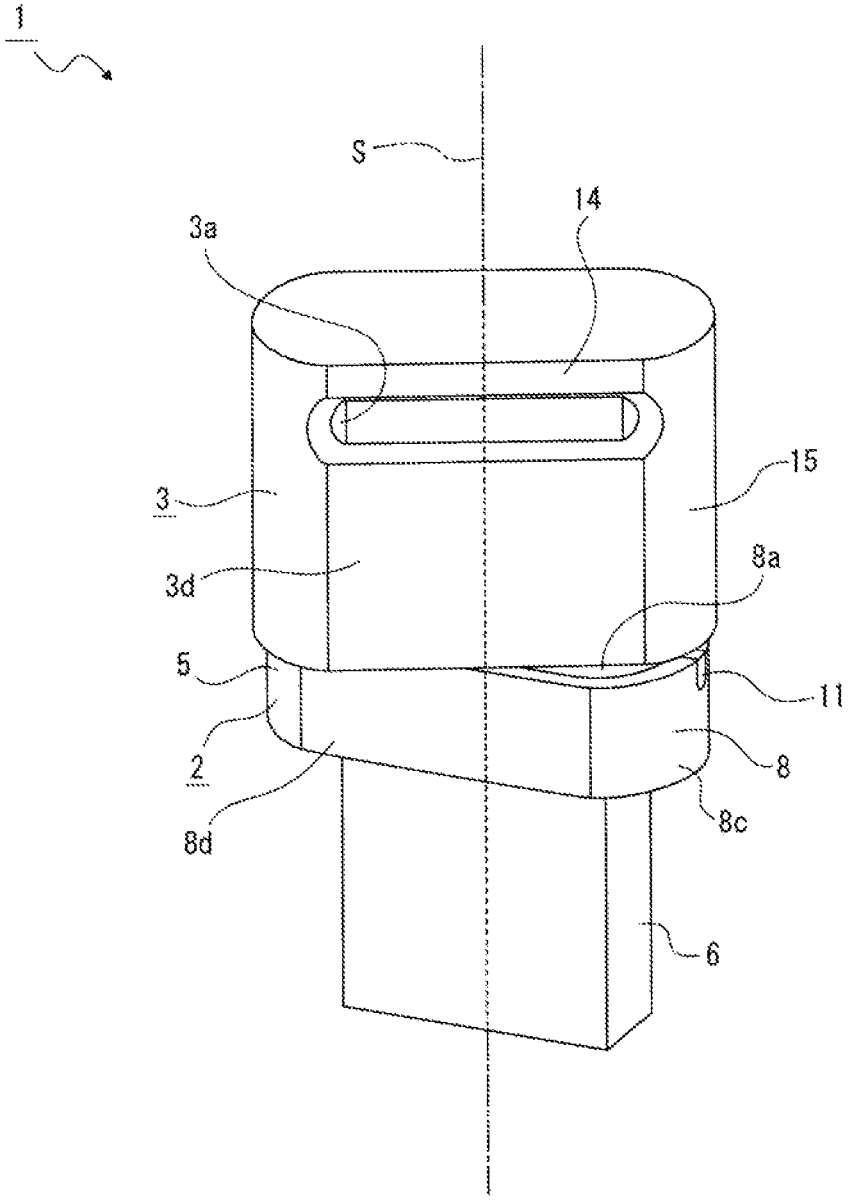
FIG. 10 is an enlarged perspective view showing a state in which the cap is in contact with the connector holding portion.
Figure 11:
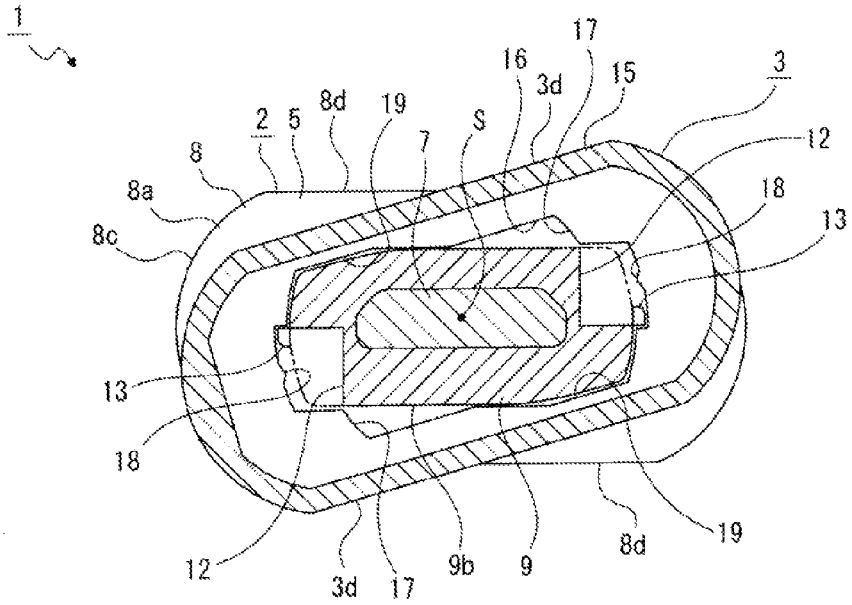
FIG. 11 is an enlarged sectional view showing the same state in FIG. 10 in which the cap is in contact with the connector holding portion.

In the state in which the cap 3 is detached from the apparatus body 2, if the cap 3 is slid with respect to the connecting band 4 in a direction in which the connector holding portion 5 is approached, the underside of the cap 3 comes into contact with the top face 8*a* of the substrate portion 8 in the connector holding portion 5 and the second connector 7 and the coupling portion 9 are covered with the cap 3 (see FIG. 10). At this point, a state in which respective portions of the coupling portion 9 are inserted into the clearance recesses 19, 19 of the cap 3 is created (see FIG. 11). Therefore, the cap 3 is put into a state of being displaced by a predetermined angle with respect to the apparatus body 2 using a rotation axis S, which extends in an up and down direction and is parallel to the insertion directions A1, A2 and the pulling directions B1, B2, as a support and is also put into a state in which the plane portions 3*d*, 3*d* of the cap 3 are inclined with respect to the plane portions 8*d*, 8*d* of the substrate portion 8 respectively.

Figure 12:
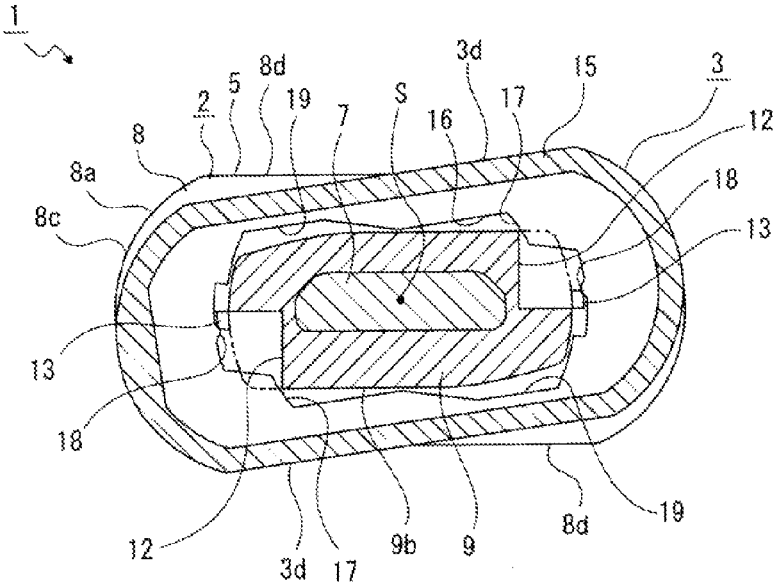
FIG. 12 is an enlarged sectional view showing a state in which the cap is rotated with respect to the connector holding portion.

Next, the cap 3 is rotated with respect to the apparatus body 2 in an axis rotating direction of the rotation axis S (see FIG. 12). When the cap 3 is rotated with respect to the apparatus body 2, the stopping projections 18, 18 of the cap 3 are engaged with the engagement projections 13, 13 of the coupling portion 9 respectively and also portions of the locked portions 17, 17 of the cap 3 are inserted into the locking portions 12, 12 of the coupling portion 9 respectively.

The cap 3 of the storage apparatus 1 has the plane portions 3*d*, 3*d* formed thereon and the user can rotate the cap 3 by putting his (her) finger on the plane portions 3*d*, 3*d* while the cap 3 rotates with respect to the apparatus body 2. Therefore, a rotation operation of the cap 3 with respect to the connector holding portion 5 can be performed easily and reliably.

Figure 13:
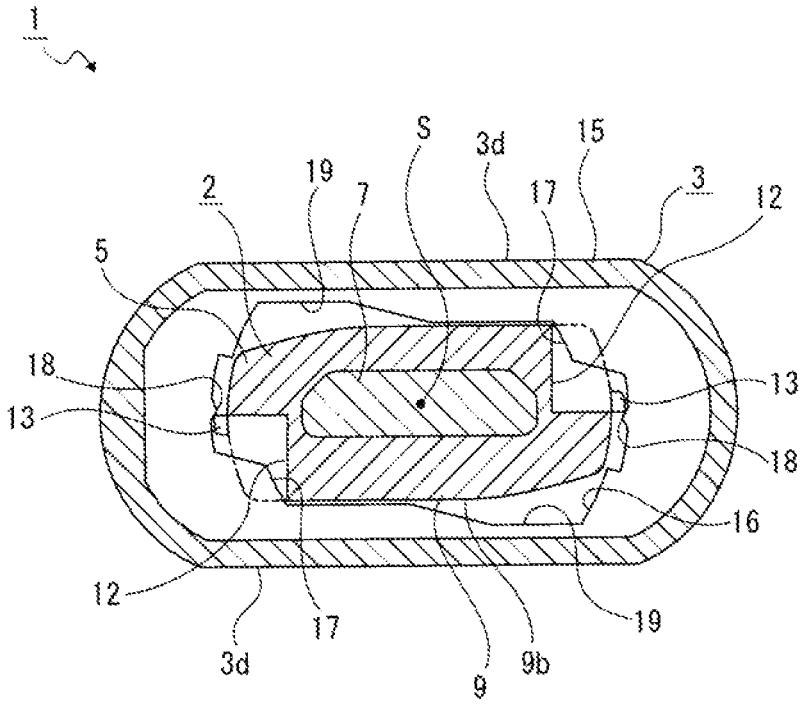
FIG. 13 is an enlarged sectional view showing a state in which the cap is locked with respect to the connector holding portion.
Figure 14:
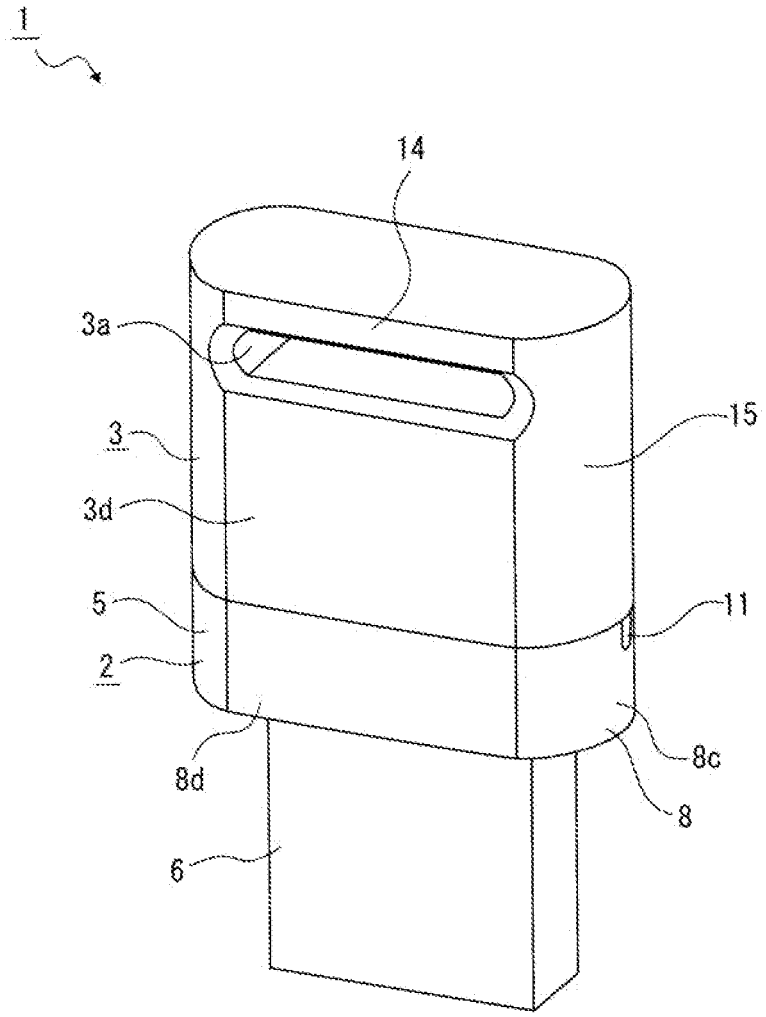
FIG. 14 is an enlarged perspective view showing a state in which the cap is attached to the connector holding portion and is locked with respect to the connector holding portion.
Figure 15:
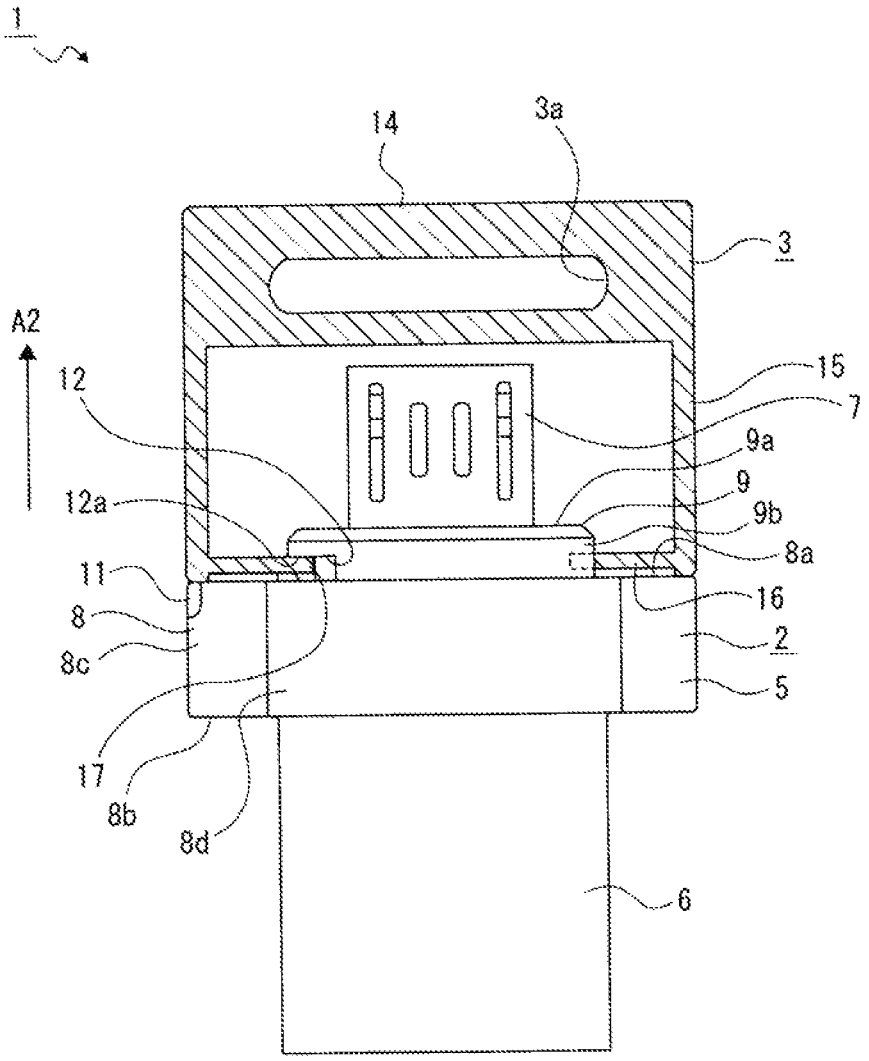
FIG. 15 is an enlarged sectional view showing a state in which the cap is attached to the connector holding portion and is locked with respect to the connector holding portion cut in a different section from that in FIG. 13.

The cap 3 is further rotated with respect to the apparatus body 2 in the axis rotating direction of the rotation axis S (see FIG. 13). If the cap 3 is further rotated with respect to the apparatus body 2, the stopping projections 18, 18 are engaged with the engagement projections 13, 13 while the engagement projections 13, 13 being climbed respectively and also the whole locked portions 17, 17 are engaged with the locking portions 12, 12 by being inserted thereinto respectively.

With the stopping projections 18, 18 being engaged with the engagement projections 13, 13 respectively and also the whole locked portions 17, 17 being engaged with the locking portions 12, 12 by being inserted thereinto respectively, the cap 3 is locked with respect to the connector holding portion 5. While the cap 3 is locked with respect to the connector holding portion 5, the plane portions 8*d*, 8*d* of the substrate portion 8 and the plane portions 3*d*, 3*d* of the cap 3 are positioned in the same plane (see FIG. 14) and the upward movement (pulling direction A2) of the cap 3 with respect to the apparatus body 2 is regulated by the regulating surfaces 12*a*, 12*a* of the locking portions 12, 12 (see FIG. 15).

The second connector 7 is covered with the cap 3 and protected by, as described above, the cap 3 being attached to the connector holding portion 5 and locked.

While the cap 3 is attached to the connector holding portion 5 and locked, the connecting band 4 is positioned inside the cap 3.

Therefore, while the cap 3 is attached to the connector holding portion 5, the connecting band 4 does not project to the outer side from the cap 3 and the connector holding portion 5 and when the storage apparatus 1 is used while the cap 3 is attached to the connector holding portion 5, the connecting band 4 does not come into contact with the hand, which makes it easier to grip the storage apparatus 1 and also makes it possible to reduce the size of the storage apparatus 1.

Also while the cap 3 is attached to the connector holding portion 5 and locked, the locking portions 12, 12 are positioned inside the cap 3.

Therefore, while the cap 3 is attached to the connector holding portion 5, the locking portions 12, 12 and the locked portions 17, 17 do not project to the outer side from the connector holding portion 5 and when the storage apparatus 1 is used while the cap 3 is attached to the connector holding portion 5, the locking portions 12, 12 and the locked portions 17, 17 do not come into contact with the hand, which makes it easier to grip the storage apparatus 1 and also makes it possible to reduce the size of the storage apparatus 1.

While the cap 3 is attached to the connector holding portion 5 and locked as described above, the first connector 6 of the storage apparatus 1 is inserted into and connected to the connection terminal 101 of the electronic device 100 to exchange data with the electronic device 100.

In the storage apparatus 1, the first connector 6 is projected in one direction from the connector holding portion 5 and the locking portions 12, 12 are provided in a portion of the connector holding portion 5 on the opposite side of the side to which the first connector 6 is projected.

Therefore, while the first connector 6 is connected to the connection terminal 101, the cap 3 can be attached to the connector holding portion 5 so that the loss of the cap 3 when the storage apparatus 1 is attached to the electronic device 100 can be prevented.

In addition, the cap 3 is attached to the connector holding portion 5 and locked while covering the second connector 7 and therefore, the second connector 7 is covered with the cap 3 while the first connector 6 is connected to the connection terminal 101 and when the storage apparatus 1 is attached to the electronic device 100, the second connector 7 positioned outside the electronic device 100 can be protected.

Figure 16:
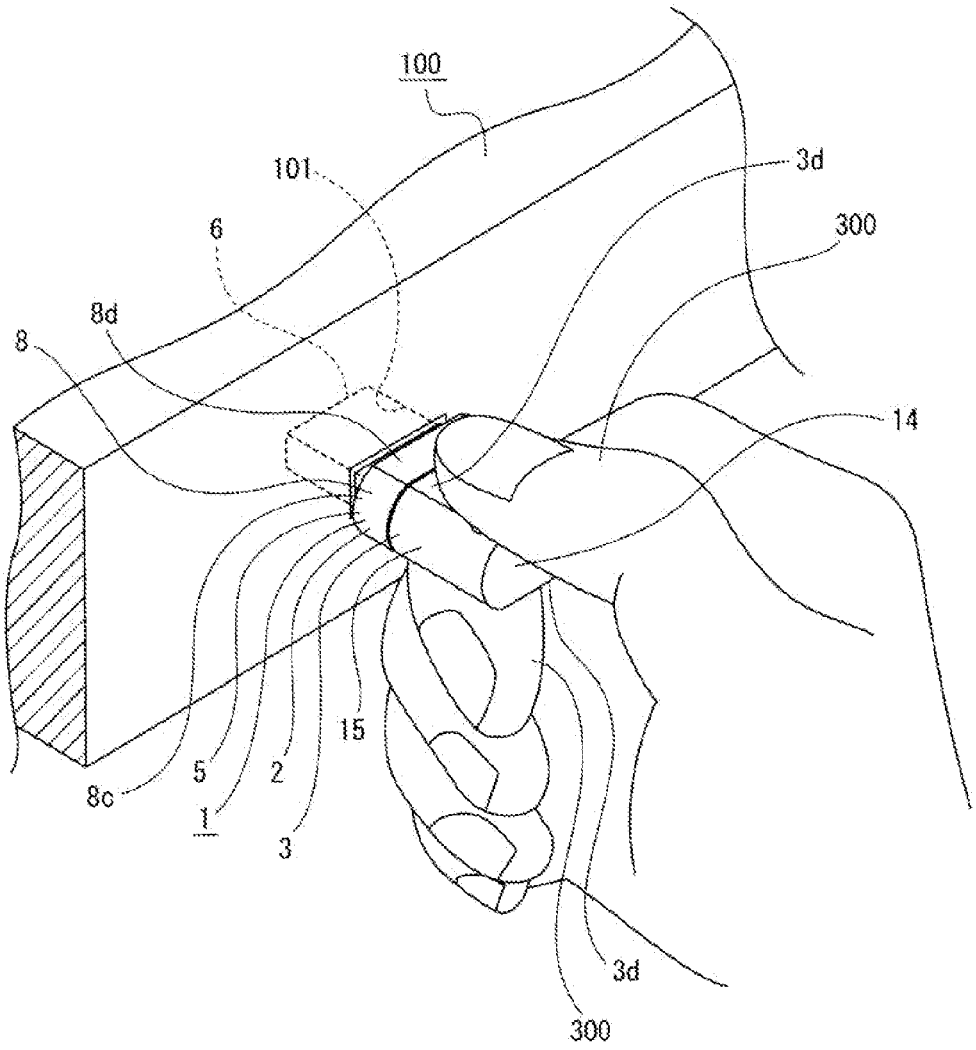
FIG. 16 is an enlarged perspective view showing a state in which a pulling operation from a connection terminal of the connector holding portion is about to be performed.

When data exchange between the electronic device 100 and the storage apparatus 1 is completed and the storage apparatus 1 is pulled out from the electronic device 100, the cap 3 is gripped by fingers 300, 300 (see FIG. 16).

The cap 3 of the storage apparatus 1 has the plane portions 3*d*, 3*d* formed thereon and the user can grip the storage apparatus 1 by putting the fingers 300, 300 on the plane portions 3*d*, 3*d*. Therefore, the storage apparatus 1 can be pulled out from the electronic device 100 by gripping the cap 3 easily and reliably.

When the storage apparatus 1 is pulled out from the electronic device 100, the cap 3 is locked with respect to the connector holding portion 5 and the movement of the cap 3 with respect to the apparatus body 2 in the pulling direction A2 is regulated and therefore, the cap 3 does not fall off the apparatus body 2.

On the other hand, it becomes possible to connect the second connector 7 to the connection terminal 201 of the electronic device 200 by unlocking of the cap 3 with respect to the apparatus body 2 to detach the cap 3 from the connector holding portion 5. The unlock of the cap 3 with respect to the apparatus body 2 can be done by rotating the cap 3 in a direction opposite to the rotation direction when the cap 3 is attached to the connector holding portion 5.

If the cap 3 is rotated in the opposite direction while the cap 3 is locked with respect to the connector holding portion 5, the stopping projections 18, 18 of the cap 3 and the engagement projections 13, 13 of the coupling portion 9 are disengaged respectively and also the locked portions 17, 17 of the cap 3 are pulled out from the locking portions 12, 12 of the coupling portion 9. By sliding the cap 3 with respect to the connecting band 4 in a direction moving away from the connector holding portion 5 in this state, a protection state of the second connector 7 by the cap 3 is ended and connection of the second connector 7 to the connection terminal 201 is enabled.

In the storage apparatus 1, as described above, the cap 3 is locked with respect to the connector holding portion 5 and unlocked with respect to the connector holding portion 5 by the cap 3 being rotated in an axis rotating direction of the rotation axis S parallel to the insertion directions A1, A2.

Therefore, the locking portions 12, 12 and the locked portions 17, 17 are engaged and disengaged by the rotation of the cap 3 with respect to the connector holding portion 5 and therefore, an attaching/detaching operation of the cap 3 to/from the connector holding portion 5 can easily be performed.

Also in the storage apparatus 1, the cap 3 is made slidable with respect to the connecting band 4.

Therefore, by sliding the cap 3 with respect to the connecting band 4 while the cap 3 and the connector holding portion 5 are connected to the connecting band 4, the cap 3 and the connector holding portion 5 can be separated or contacted and the connecting band 4 functions as a guide when the cap 3 is attached/detached to/from the connector holding portion 5 so that an attaching/detaching operation of the cap 3 to/from the connector holding portion 5 can be performed easily and reliably.

Figure 17:
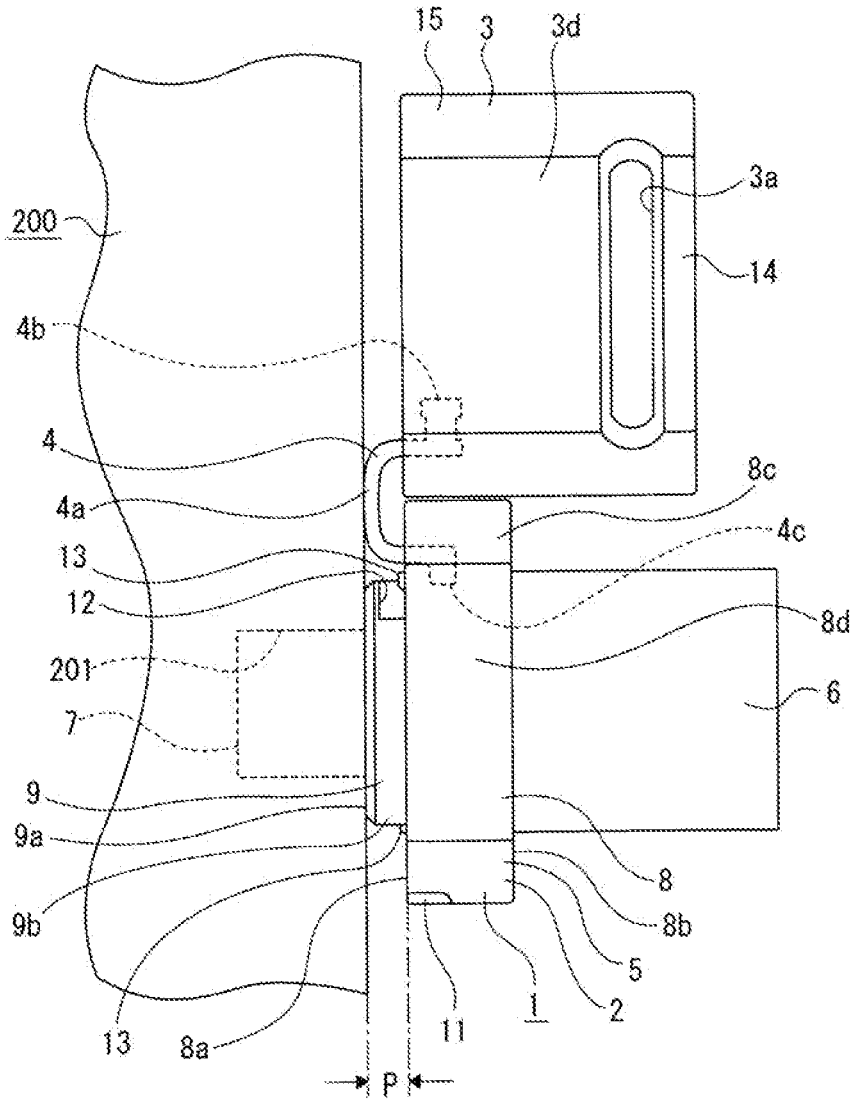
FIG. 17 is an enlarged front view showing a state in which a second connector is connected to the connection terminal of the electronic device.

While the second connector 7 is connected to the connection terminal 201, the cap 3 is detached from the connector holding portion 5, but the cap 3 is connected to the connector holding portion 5 by the connecting band 4 (see FIG. 17).

Therefore, the loss of the cap 3 when the storage apparatus 1 is attached to the electronic device 200 can be prevented.

In addition, the connecting band 4 is made elastically deformable and therefore, the connecting band 4 is bendable while the cap 3 is detached from the connector holding portion 5 and the second connector 7 can smoothly inserted into and connected to the connection terminal 201 without the connecting band 4 interfering with the insertion of the second connector 7 into the connection terminal 201.

Further, while the second connector 7 is connected to the connection terminal 201, the top surface 9*a* of the coupling portion 9 in the connector holding portion 5 is opposed to or in contact with the outside surface (side face) of the electronic device 200 and a fixed space P is formed between the side face of the electronic device 200 and the top face 8*a* of the substrate portion 8.

Therefore, the arrangement space of the connecting portion 4*a* of the connecting band 4 is secured in the space P and damage to the connecting band 4 can be prevented without the connecting band 4 being crushed by the side face of the electronic device 200 and the connector holding portion 5 and also a stable connected state of the second connector 7 to the connection terminal 201 can be secured.

In addition, the space P is formed between the side face of the of the electronic device 200 and the top face 8*a* of the substrate portion 8 and so when an attempt is made to pull out the storage apparatus 1 from the electronic device 200, the substrate portion 8 can be gripped by inserting a fingertip into the space P and therefore, a pulling operation of the storage apparatus 1 from the electronic device 200 can be performed easily and reliably.

[Another Example of the Storage Apparatus]

A storage apparatus 1A as another example of the storage apparatus 1 will be described below (see FIGS. 18 to 21).

When compared with the above storage apparatus 1, the storage apparatus 1A shown below is different only in the positions and configurations of the locking portions and the locked portions and therefore, only differences when compared with the storage apparatus 1 will be described in detail and a detailed description of other portions is omitted by attaching the same reference signs as those attached to similar portions in the storage apparatus 1.

Figure 18:
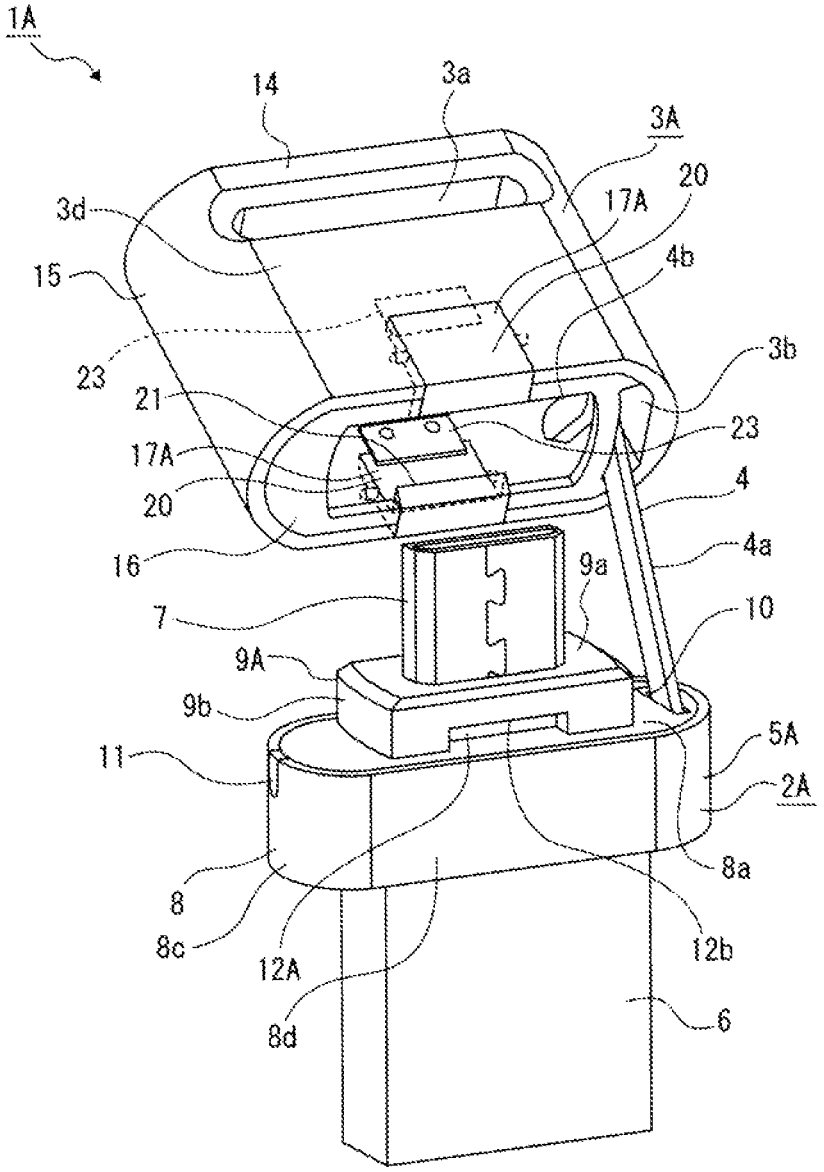
FIG. 18 shows another example of the storage apparatus together with FIGS. 19 to 21 and is an enlarged perspective view of the storage apparatus shown in the state in which the cap is detached from the connector holding portion.
Figure 19:
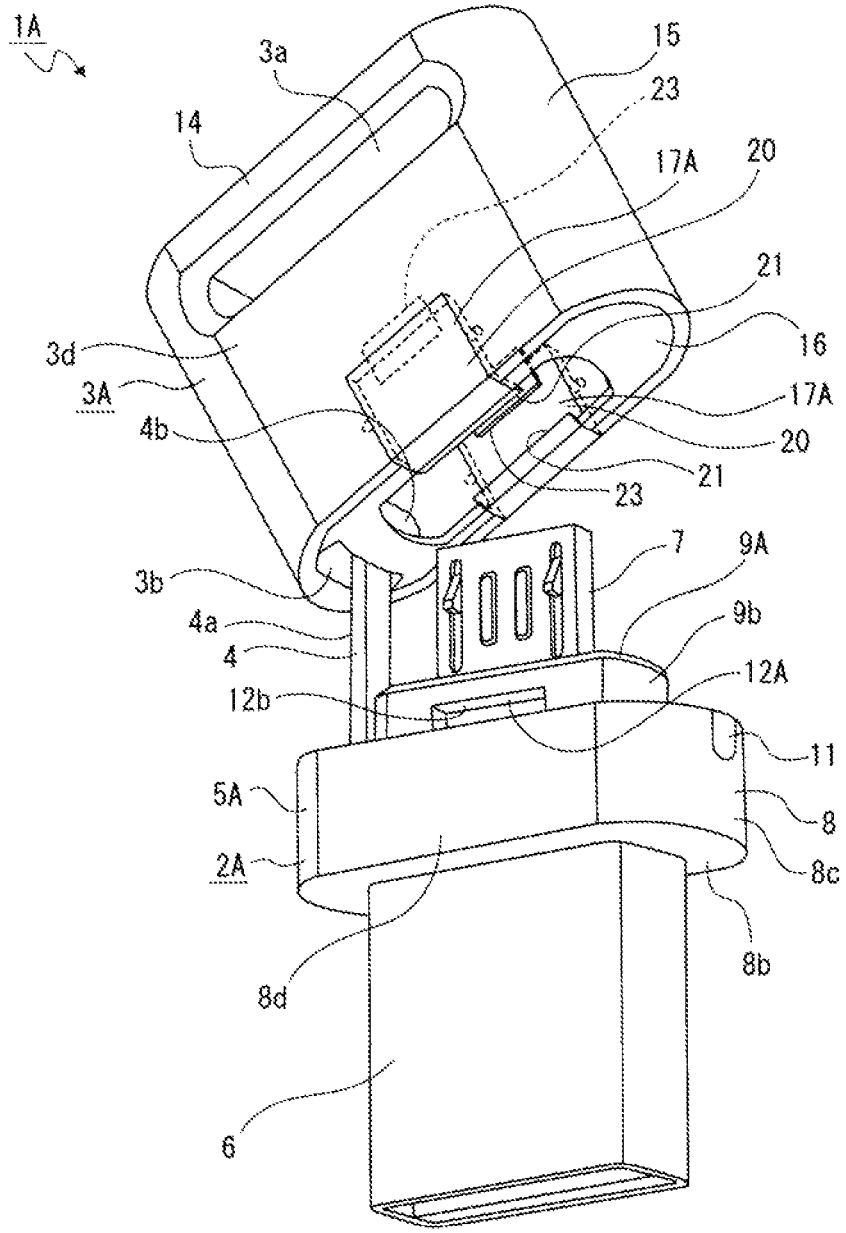
FIG. 19 is an enlarged perspective view of the storage apparatus showing the state in which the cap is detached from the connector holding portion when viewed from a direction different from that in FIG. 18.
Figure 20:
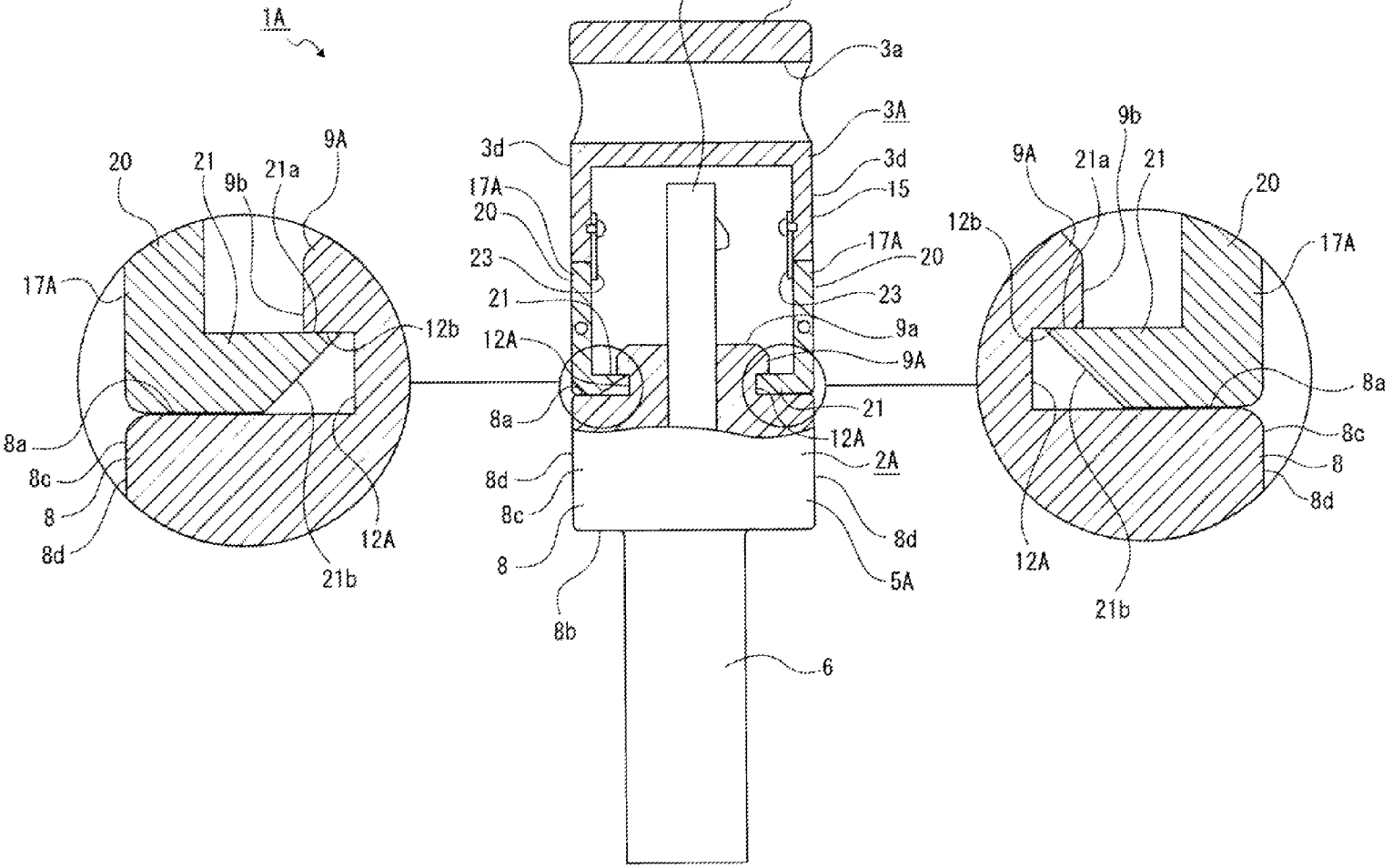
FIG. 20 is an enlarged sectional view showing a state in which the cap is attached to the connector holding portion and is locked with respect to the connector holding portion.

The storage apparatus 1A includes an apparatus body 2A, a cap 3A, and the connecting band 4 and the apparatus body 2A includes a connector holding portion 5A and the first connector 6 and the second connector 7, each held by the connector holding portion 5A (see FIGS. 18 to 20).

The connector holding portion 5A is formed by the substrate portion 8 and a coupling portion 9A being integrally formed. In the connector holding portion 5A, locking portions 12A, 12A are formed in the coupling portion 9A.

The locking portions 12A, 12A are formed, for example, on both ends in the forward and backward direction of the coupling portion 9A. The locking portion 12A is opened to the outer side and upward and the width of the top end portion in the forward and backward direction is made smaller than the width of a lower portion in the forward and backward direction. An upper wall surface forming the locking portion 12A and oriented downward is formed as a regulating surface 12*b*.

The coupling portion 9A is not provided with any engagement projection.

The cap 3A includes the base portion 14 and the circumferential surface portion 15 and the cap 3A is not provided with any overhanging surface portion. The cap 3A is provided with locked portions 17A, 17A, for example, on both ends in the forward and backward direction.

The locked portions 17A, 17A include arm portions 20, 20 extending in an up and down direction and locking projections 21, 21 projected in mutually approaching directions from lower ends of the arm portions 20, 20 and are freely rotationally movably supported by the circumferential surface portion 15 using an intermediate portion of the arm portions 20, 20 in the up and down direction as a supporting point. The locking projection 21 includes a regulated surface 21*a* oriented upward and an inclined plane 21*b* whose top end continues to the tip of the regulated surface 21*a* and which moves away from the regulated surface 21*a* in the forward and backward direction while moving downward.

For example, energizing springs 22, 22 as plate springs are attached to the inner surface of the cap 3 and the locked portions 17A, 17A are energized by the energizing springs 22, 22 by lower portions of the energizing springs 22, 22 being pressed against the inner surfaces in the top end portions of the arm portions 20, 20 respectively. The locked portions 17A, 17A are energized in a rotational moving direction in which the locking projections 21, 21 are brought closer to each other by the energizing springs 22, 22.

Figure 21:
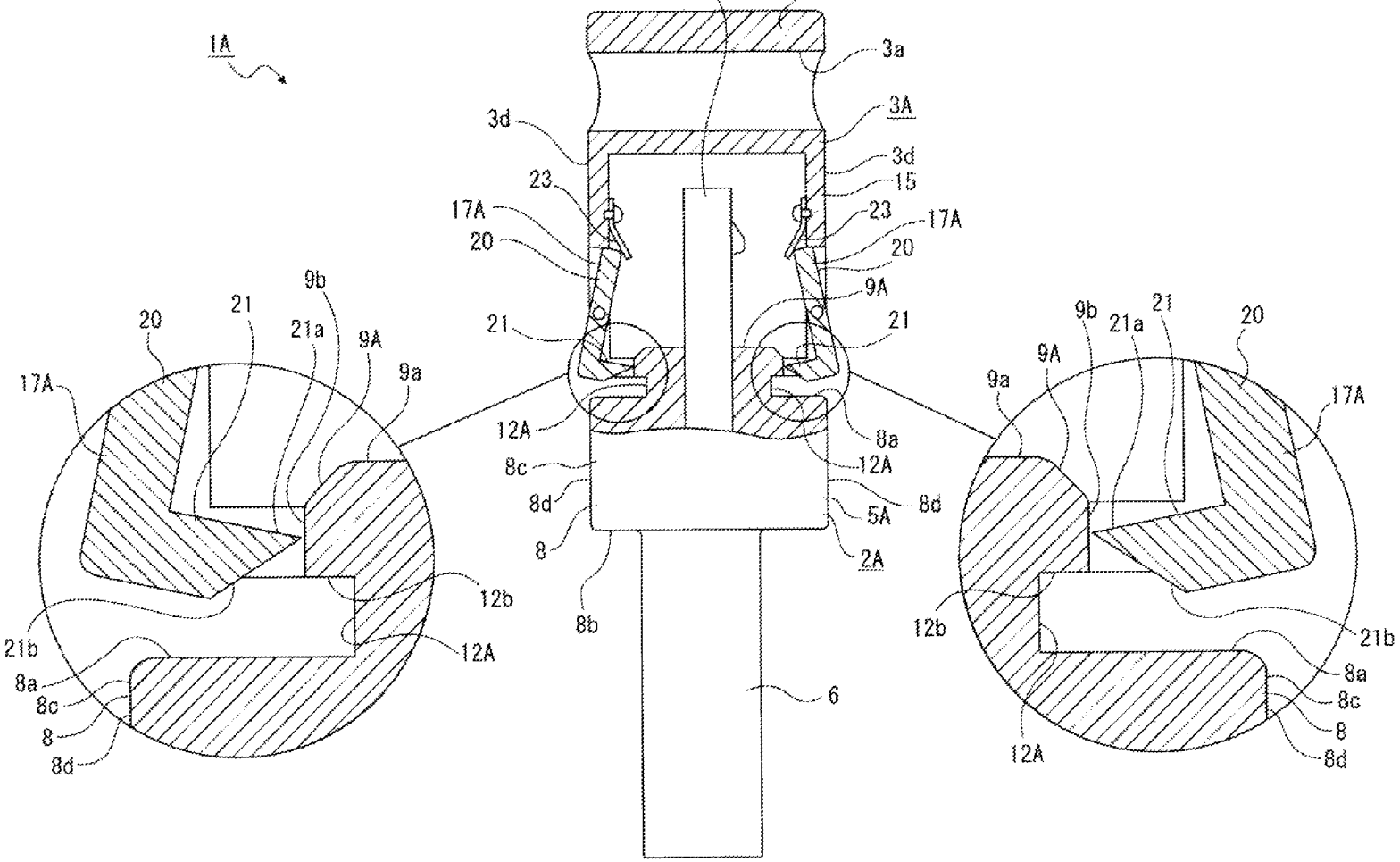
FIG. 21 is an enlarged sectional view showing a state before the cap is locked with respect to the connector holding portion.

If the cap 3A is moved downward with respect to the connector holding portion 5A while the cap 3A is detached from the apparatus body 2A, the inclined planes 21*b*, 21*b* of the locking projections 21, 21 in the locked portions 17A, 17A are slid to edges on both sides in the forward and backward direction of the coupling portion 9A respectively (see FIG. 21). When the inclined planes 21*b*, 21*b* of the locking projections 21, 21 are slid to edges on both sides in the forward and backward direction of the coupling portion 9A respectively, the locking portions 12A, 12A are rotationally moved in a direction in which the locking projections 21, 21 move away from each other against energizing forces of the energizing springs 22, 22.

If the cap 3A is further moved downward with respect to the connector holding portion 5A, the regulated surfaces 21*a*, 21*a* of the locking projections 21, 21 match the regulating surfaces 12*b*, 12*b* of the coupling portion 9A respectively and the locking portions 12A, 12A are rotationally moved in a direction in which the locking projections 21, 21 are brought closer to each other by energizing forces of the energizing springs 22, 22 (see FIG. 20). If the locking portions 12A, 12A are rotationally moved by energizing forces of the energizing springs 22, 22, the locking projections 21, 21 are inserted into the locking portions 12A, 12A, the regulated surfaces 21*a*, 21*a* are stopped by the regulating surfaces 12*b*, 12*b*, and the cap 3A is locked with respect to the connector holding portion 5A.

While the cap 3A is locked with respect to the connector holding portion 5A, the second connector 7 and the coupling portion 9A are covered with the cap 3A to protect the second connector 7. Also while the cap 3A is locked with respect to the connector holding portion 5A, the upward (pulling direction A2) movement of the cap 3A with respect to the apparatus body 2A is regulated by the regulating surfaces 12*b*, 12*b* of the locking portions 12A, 12A.

While the cap 3A is locked with respect to the connector holding portion 5A, the locked portions 17A, 17A are rotationally moved against energizing forces of the energizing springs 22, 22 by top end portions of the arm portions 20, 20 being pressed by fingers in directions such that the top end portions are brought closer to each other. The locking projections 21, 21 are removed from the locking portions 12A, 12A to release a locked state by the locked portions 17A, 17A being rotationally moved against energizing forces of the energizing springs 22, 22 and the cap 3A is detached from the apparatus body 2A by, in this state, the cap 3A being moved upward with respect to the connector holding portion 5A.

In the storage apparatus 1A, as described above, the cap 3A is locked with respect to the connector holding portion 5A and unlocked with respect to the connector holding portion 5A by the cap 3A being moved in the insertion direction A1 or the pulling direction A2 with respect to the connector holding portion 5A.

Therefore, the locking portions 12A, 12A and the locked portions 17A, 17A are engaged and disengaged by the movement of the cap 3A with respect to the connector holding portion 5A and therefore, an attaching/detaching operation of the cap 3A to/from the connector holding portion 5A can easily be performed.

An example in which the locking portions 12A, 12A and the locked portions 17A, 17A are provided on both ends in the forward and backward direction of the cap 3A and the coupling portion 9A is shown above, but the locking portions 12A, 12A and the locked portions 17A, 17A may be provided in any portion of the outer circumferential portion of the cap 3A and the coupling portion 9A and may be provided, for example, on both ends in the left and right direction of the cap 3A and the coupling portion 9A.

Also, an example in which the locked portions 17A, 17A are configured to be rotationally movable is shown above, but conversely, the locking portions 12A, 12A may be configured to be rotationally movable and locked.

[Others]

Figure 22:
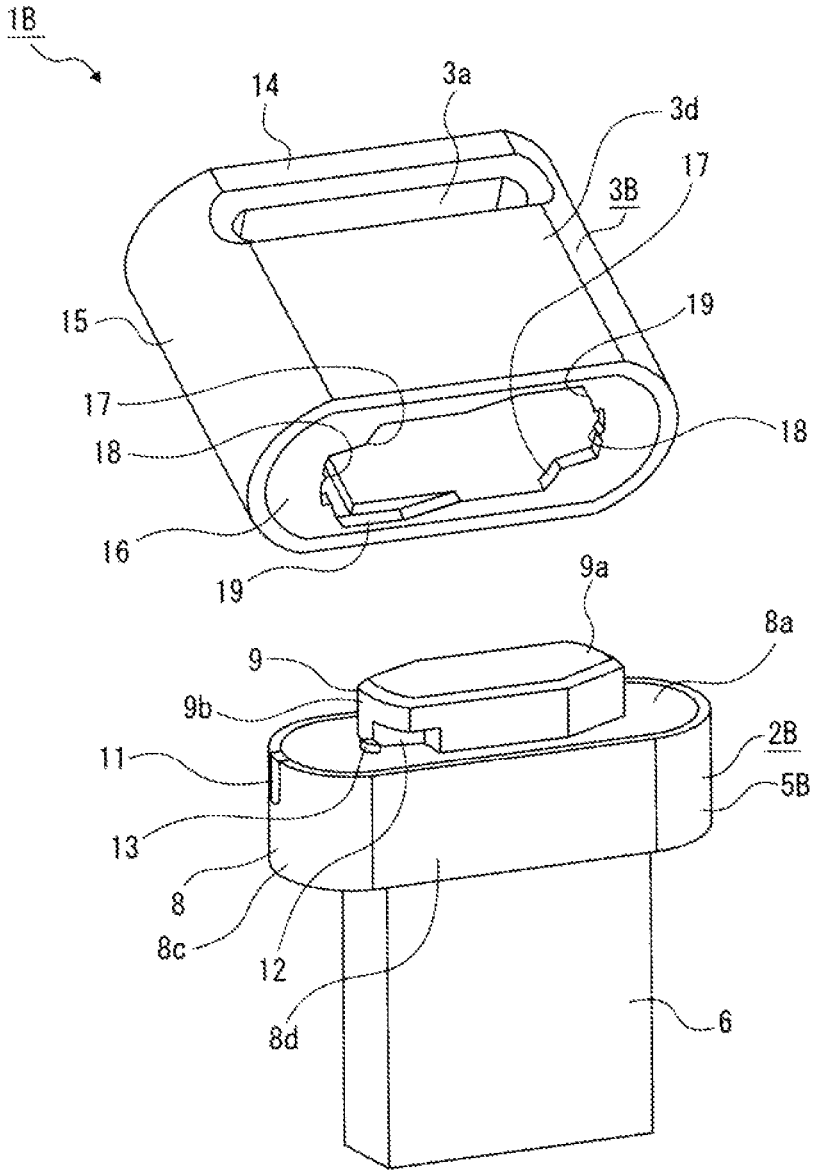
FIG. 22 shows an example of the storage apparatus in which one of connectors is not provided together with FIG. 23 and is an enlarged perspective view showing the state in which the cap is detached from the connector holding portion.

The storage apparatuses 1, 1A in which the first connector 6 and the second connector 7 are provided are shown as examples, but a storage apparatus according to the present application is not limited to a case in which two connectors, the first connector 6 and the second connector 7, are provided and, as shown in FIG. 22, a storage apparatus to which the present application is applied may be a storage apparatus 1B in which only the first connector 6 is provided.

Figure 23:
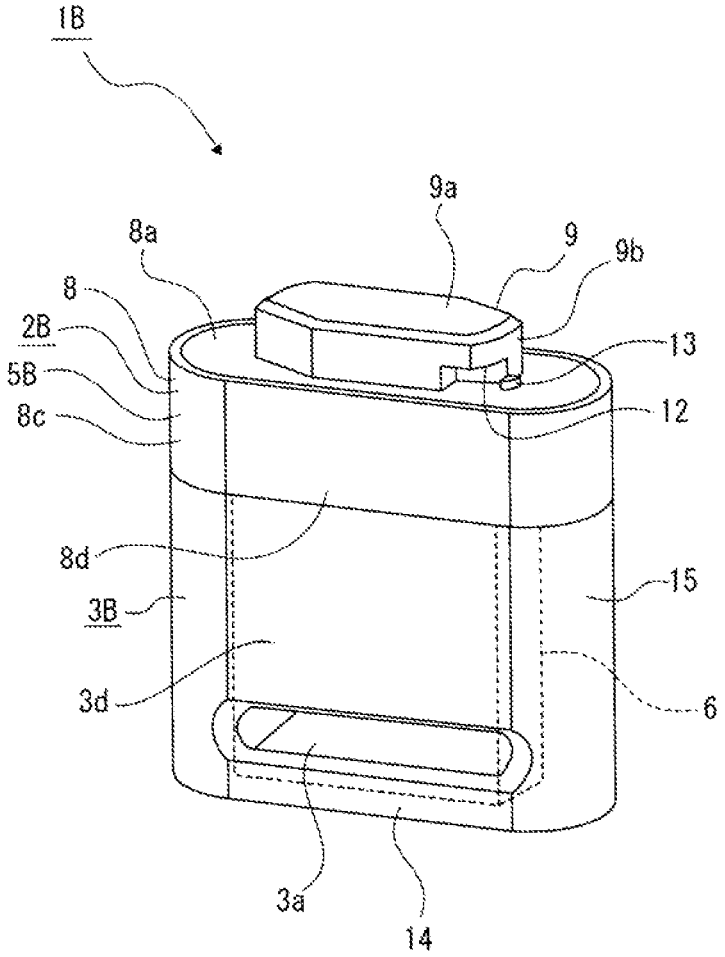
FIG. 23 is an enlarged perspective view showing the state in which the cap is attached to the connector holding portion.

In an example in which, like the storage apparatus 1B, only the first connector 6 is provided, a configuration in which the first connector 6 is protected by being covered with a cap 3B can also be adopted (see FIG. 23). In this case, when the first connector 6 is covered with the cap 3B, though not illustrated, it is necessary to provide a structure allowing the cap 3B to be attached/detached to/from a connector holding portion 5B of an apparatus body 2B.

In the storage apparatuses 1, 1A, 1B, if the detachment of the caps 3, 3A, 3B from the apparatus bodies 2, 2A, 2B in the pulling direction A2 is configured to be regulated while the first connector 6 is connected to the connection terminal 101 of the electronic device 100, any structure can be used for the locking portion and the locked portion.

A storage apparatus according to the present application can be applied to, regardless of the connector type, any type of storage apparatus in which one or more connectors are provided.

[Summary]

In the storage apparatuses 1, 1A, 1B, as described above, the locked portions 17, 17, 17A, 17A locked with respect to the connector holding portions 5, 5A, 5B are provided in the caps 3, 3A, 3B and the locking portions 12, 12, 12A, 12A regulating detachment of the caps 3, 3A, 3B engaged with the locked portions 17, 17, 17A, 17A from the apparatus bodies 2, 2A, 2B in the pulling direction A2 are provided in the connector holding portions 5, 5A, 5B.

Therefore, while the first connector 6 is connected to the connection terminal 101 of the electronic device 100, when the caps 3, 3A, 3B are attached to the connector holding portions 5, 5A, 5B and also a pulling operation of the first connector 6 from the connection terminal 101 is performed, detachment of the caps 3, 3A, 3B from the apparatus bodies 2, 2A, 2B in the pulling direction A2 is regulated by the locking portions 12, 12, 12A, 12A.

Accordingly, the loss of the caps 3, 3A, 3B can be prevented and also the caps 3, 3A, 3B can be prevented from falling off the apparatus bodies 2, 2A, 2B when a pulling operation of the first connector 6 from the connection terminal 101 is performed.

In addition, the storage apparatuses 1, 1A are provided with different types of connectors, the first connector 6 and the second connector 7, and therefore, the first connector 6 and the second connector 7 can be connected to the connection terminals 101, 201 of different types of the electronic devices 100, 200 and data can be exchanged between different types of the electronic devices 100, 200 by using the storage apparatuses 1, 1A.

Further, the first connector 6 and the second connector 7 are positioned in a state projected in the opposite directions from the connector holding portion 5 and therefore, the first connector 6 and the second connector 7 can be connected to the connection terminals 101, 201 of different types of the electronic devices 100, 200 by reversing the direction of the storage apparatuses 1, 1A, thereby improving the ease-of-use of the storage apparatuses 1, 1A.

It should be understood by those skilled in the art that various modifications, combinations, sub-combinations and alterations may occur depending on design requirements and other factors insofar as they are within the scope of the appended claims or the equivalents thereof.

[Present Application]

Additionally, the present application may also be configured as below.

(1) A storage apparatus including:

an apparatus body including at least one connector connected by being inserted into a connection terminal provided in an electronic device and disconnected by being pulled out from the connection terminal and a connector holding portion holding the connector; and a cap attached/detached to/from the connector holding portion, wherein a direction in which the connector is inserted into the connection terminal is set as an insertion direction, wherein a direction in which the connector is pulled out from the connection terminal is set as a pulling direction, wherein the cap is provided with a locked portion locked with respect to the connector holding portion, and wherein the connector holding portion is provided with a locking portion engaged with the locked portion to regulate detachment of the cap from the connector holding portion in the pulling direction.

(2) The storage apparatus according to (1), wherein the cap is locked with respect to the connector holding portion and unlocked with respect to the connector holding portion by the cap being rotated in an axis rotating direction of an axis parallel to the insertion direction with respect to the connector holding portion.

(3) The storage apparatus according to (1) or (2), wherein a plane portion is formed on an outside surface of the cap.

(4) The storage apparatus according to (1) or (3), wherein the cap is locked with respect to the connector holding portion and unlocked with respect to the connector holding portion by the cap being moved in the insertion direction or the pulling direction with respect to the connector holding portion.

(5) The storage apparatus according to any one of (1) to (4), wherein the connector is projected in one direction from the connector holding portion, and wherein the locking portion is provided in a portion on an opposite side of a side on which the connector is projected.

(6) The storage apparatus according to any one of (1) to (5), wherein different types of a first connector and a second connector are provided as the connector.

(7) The storage apparatus according to (6), wherein the first connector and the second connector are positioned in a state projected in opposite directions from the connector holding portion.

(8) The storage apparatus according to (7), wherein the cap is attached to the connector holding portion and locked in the state covering the second connector.

(9) The storage apparatus according to any one of (1) to (8), wherein a connecting band connecting the cap and the connector holding portion is provided.

(10) The storage apparatus according to (9), wherein the connecting band is made elastically deformable.

(11) The storage apparatus according to (9) or (10), wherein the cap is made slidable with respect to the connecting band.

(12) The storage apparatus according to any one of (9) to (11), wherein the connecting band is positioned inside the cap while the cap is attached to the connector holding portion.

(13) The storage apparatus according to any one of (1) to (12), wherein the locked portion is provided on an inner surface side of the cap, and wherein the locking portion is positioned inside the cap while the cap is attached to the connector holding portion.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A storage apparatus comprising:

an apparatus body including at least one connector configured to be connected by being inserted into a connection terminal provided in an electronic device, and disconnected by being pulled out from the connection terminal, and a connector holding portion configured to hold the connector; and a cap that is removably attachable to the connector holding portion, wherein a direction in which the connector is inserted into the connection terminal is set as an insertion direction, wherein a direction in which the connector is pulled out from the connection terminal is set as a pulling direction, wherein the cap is provided with a locked portion, wherein the connector holding portion has an extended coupling portion provided with a locking portion that is engageable with the locked portion to restrict detachment of the cap from the connector holding portion in the pulling direction, wherein the cap is configured to be locked and unlocked with respect to the connector holding portion by rotating the cap relative to the connector holding portion about an axis that extends along the insertion direction such that the locked portion engages or disengages with the locking portion, respectively, wherein the connector is projected in one direction from the connector holding portion, and wherein the locking portion is provided in a portion on an opposite side of a side on which the connector is projected.

2. The storage apparatus according to claim 1, wherein a plane portion is formed on an outside surface of the cap.

3. The storage apparatus according to claim 1, wherein different types of a first connector and a second connector are provided as the connector.

4. The storage apparatus according to claim 3, wherein the first connector and the second connector are positioned in a state projected in opposite directions from the connector holding portion.

5. The storage apparatus according to claim 4, wherein the cap is attached to the connector holding portion and locked in the state covering the second connector.

6. The storage apparatus according to claim 1, further comprising a connecting band connecting the cap and the connector holding portion.

7. The storage apparatus according to claim 6, wherein the connecting band is elastically deformable.

8. The storage apparatus according to claim 6, wherein the cap is slidable with respect to the connecting band.

9. The storage apparatus according to claim 6, wherein the connecting band is positioned inside the cap while the cap is attached to the connector holding portion.

10. The storage apparatus according to claim 1, wherein the locked portion is provided on an inner surface side of the cap, and wherein the locking portion is positioned inside the cap while the cap is attached to the connector holding portion.

* * * * *